US006690806B1

(12) United States Patent
Darbut et al.

(10) Patent No.: US 6,690,806 B1
(45) **Date of Patent: *Feb. 10, 2004**

(54) VARIOUS DIRECTIONAL/OMNI-DIRECTIONAL HEARING AID MICROPHONE AND HOUSING STRUCTURES

(75) Inventors: Alexander L. Darbut, Edina, MN (US); Gerald D. Richels, Blaine, MN (US); Scott Robinson, Forest Lake, MN (US)

(73) Assignee: Resistance Technology, Inc., Arden Hills, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/538,699

(22) Filed: Mar. 30, 2000

Related U.S. Application Data

(60) Provisional application No. 60/127,421, filed on Apr. 1, 1999.

(51) Int. Cl.[7] ..... H04R 25/00

(52) U.S. Cl. ..... 381/313; 381/356; 381/357

(58) Field of Search ..... 381/322, 313, 381/356, 328, 355, 357, 358, 381, 361, 345, 369, FOR 128, FOR 138, FOR 134, FOR 142, FOR 147, FOR 148

(56) References Cited

U.S. PATENT DOCUMENTS

| | | | | | |
|---|---|---|---|---|---|
| 3,835,263 | A | * | 9/1974 | Killion | 381/313 |
| 3,836,732 | A | | 9/1974 | Johanson et al. | 179/107 FD |
| 3,909,556 | A | * | 9/1975 | Johanson | 381/313 |
| 4,051,330 | A | | 9/1977 | Cole | 179/107 FD |
| 4,142,072 | A | | 2/1979 | Berland | 179/107 FD |
| 5,933,510 | A | * | 8/1999 | Bryant et al. | 381/356 |
| 6,151,399 | A | * | 11/2000 | Killion et al. | 381/313 |

* cited by examiner

*Primary Examiner*—Curtis Kuntz
*Assistant Examiner*—Brian Ensey
(74) *Attorney, Agent, or Firm*—Kinney & Lange, P.A.

(57) ABSTRACT

A microphone construction for use in a hearing aid wherein a faceplate separates a switching mechanism from a microphone having first and second acoustic ports. The first and second acoustic ports are placed into acoustic relationships with first and second acoustic opening within the faceplate by first and second acoustic passages, respectively. The switching mechanism is positionable between a first position wherein the first and second acoustic ports are in an acoustically receptive state and a second position wherein either the first or second acoustic port is in an acoustically receptive state and the other acoustic port is in an acoustically unreceptive state.

36 Claims, 30 Drawing Sheets

SECTION B-B

SECTION F-F

SECTION A-A

SECTION B-B

SECTION A-A

SECTION B-B

SECTION A-A

SECTION B-B

SECTION A-A

SECTION B-B

SECTION C-C

SECTION B-B

SECTION A-A

SECTION A-A

VARIOUS DIRECTIONAL/OMNI-DIRECTIONAL HEARING AID MICROPHONE AND HOUSING STRUCTURES

Applicant claims priority of U.S. Provisional Application No. 60/127,421; filed Apr. 1, 1999.

BACKGROUND OF THE INVENTION

The present invention relates to microphones for use in hearing aids. In particular, the present invention relates to microphone construction having a switching element capable of mechanically positioning the microphone into an omni-directional or directional mode.

Hearing aids that have the capabilities of a directional microphone and an omni-directional microphone are advantageous to the user. In certain situations an omni-directional microphone is preferred to a directional microphone and vice versa. For example, in a reverberant environment or in an environment that has background noise, a directional microphone will improve speech intelligibility. Directional microphones are also preferred when the sound source is close to the hearing aid user. In addition, attenuation of sounds coming from the rear provide better listening comfort in a noisy environment. Likewise, in other environments, directionality may not be needed, and in fact, may be a detriment.

For purposes of this application, by directional microphone is meant a microphone having two physically separated acoustic ports which acoustically relate back to opposite sides of a microphone diaphragm. In contrast, an omni-directional microphone has only one acoustic port which acoustically relates to only one side of the microphone diaphragm.

In the past, two microphones have been included in hearing aids, one an omni-directional microphone and the other a directional microphone. The hearing aid user may switch electronically from one to the other. David Preves, *Directional Microphone Use in ITE Hearing Instruments*, The Hearing Review, July 1997; Olson et al., *Performance of SENSO C9 Directional*, Widexpress, July 1997. This type of hearing aid construction has the disadvantage of the cost of two microphones and the added space that two microphones require.

There have also been attempts to provide a hearing aid that permits the user to select between directional or omni-directional modes using one microphone. Such hearing aid constructions are described in the following patents:

| Inventor | Patent No. |
|---|---|
| Killion | 3,835,263 |
| Johanson et al. | 3,836,732 |
| Johanson et al. | 3,909,556 |
| Cole | 4,051,330 |
| Berland | 4,142,072 |

However, the hearing aid constructions in the above mentioned patents are not conducive to a miniature-in-the ear type of hearing aid construction since the switching mechanisms and the acoustic channels take up too much space.

BRIEF SUMMARY OF THE INVENTION

The present invention includes a microphone construction for use in a hearing aid wherein a faceplate separates a switching mechanism from a microphone having first and second acoustic ports. The first and second acoustic ports are placed into acoustic relationships with first and second acoustic openings within the faceplate by first and second acoustic passages, respectively. The switching mechanism is positionable between a first position wherein the first and second acoustic ports are in an acoustically receptive state and a second position wherein either the first or second acoustic port is in an acoustically receptive state and the other acoustic port is in an acoustically unreceptive state.

DETAILED DESCRIPTION OF THE PREFERRED EMBODIMENT

Figure 1:
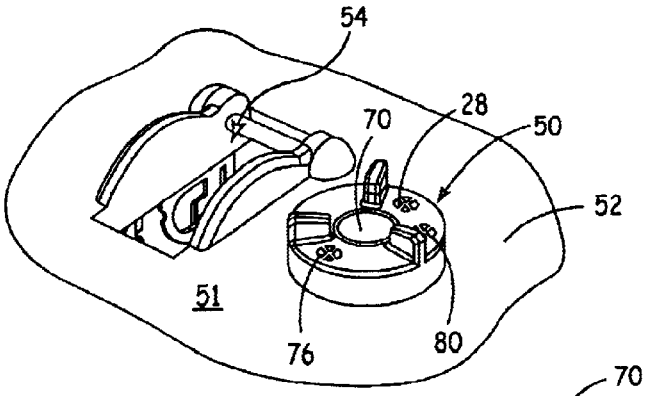
FIG. 1 is a partial perspective view of an embodiment of the present invention showing a switching mechanism rotatably secured to a faceplate.
Figure 2:
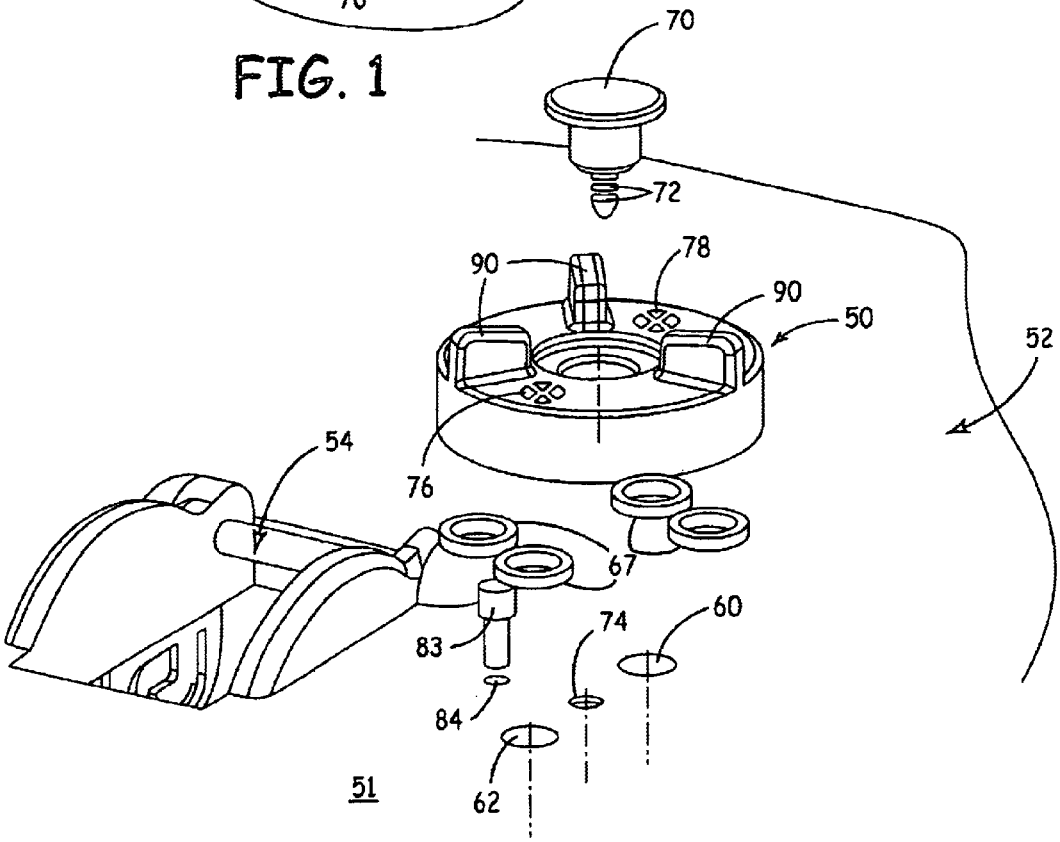
FIG. 2 is a partial exploded perspective view of the embodiment of the present invention showing the switching mechanism and the faceplate.

The present invention provides in a hearing aid selectability between an omni-directional and a directional microphone mode in a number of constructions. In a first embodiment illustrated in FIGS. 1 through 6 a switching mechanism 50 is positioned on an outside surface 51 of a faceplate 52 in close proximity to a battery compartment 54.

Figure 3:
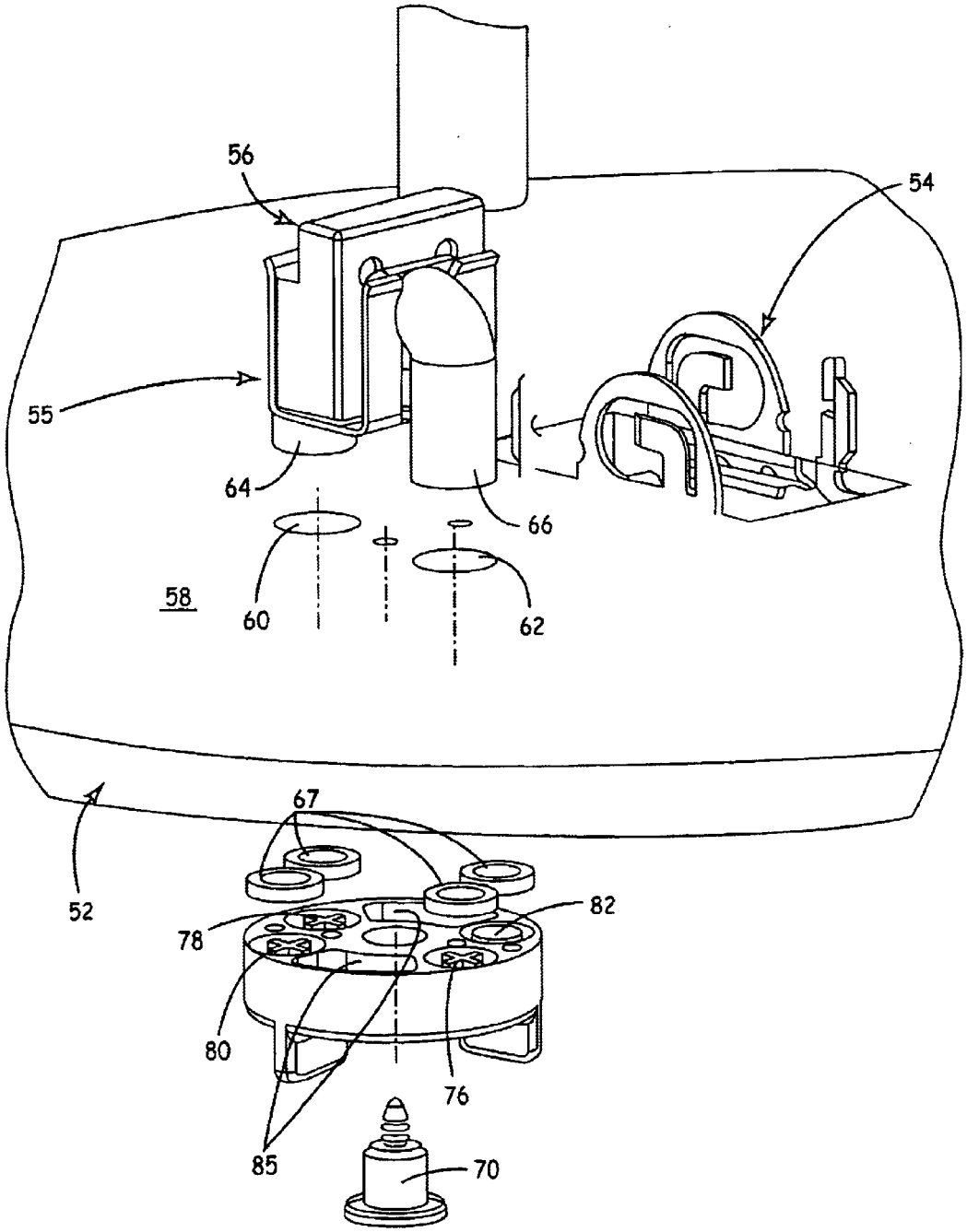
FIG. 3 is an exploded perspective view of the embodiment of the present invention.

As further illustrated in FIG. 3, a directional microphone construction 55 is positioned on an inside surface 58 of the faceplate 52. As clearly illustrated between FIGS. 2 and 3, the faceplate 52 includes acoustic openings 60 and 62 which extend through the faceplate from the outside surface 51 to the inside surface 58. The acoustic openings 60 and 62 are in acoustic relationship with acoustic passages 64 and 66 of a directional microphone 56.

Figure 6:
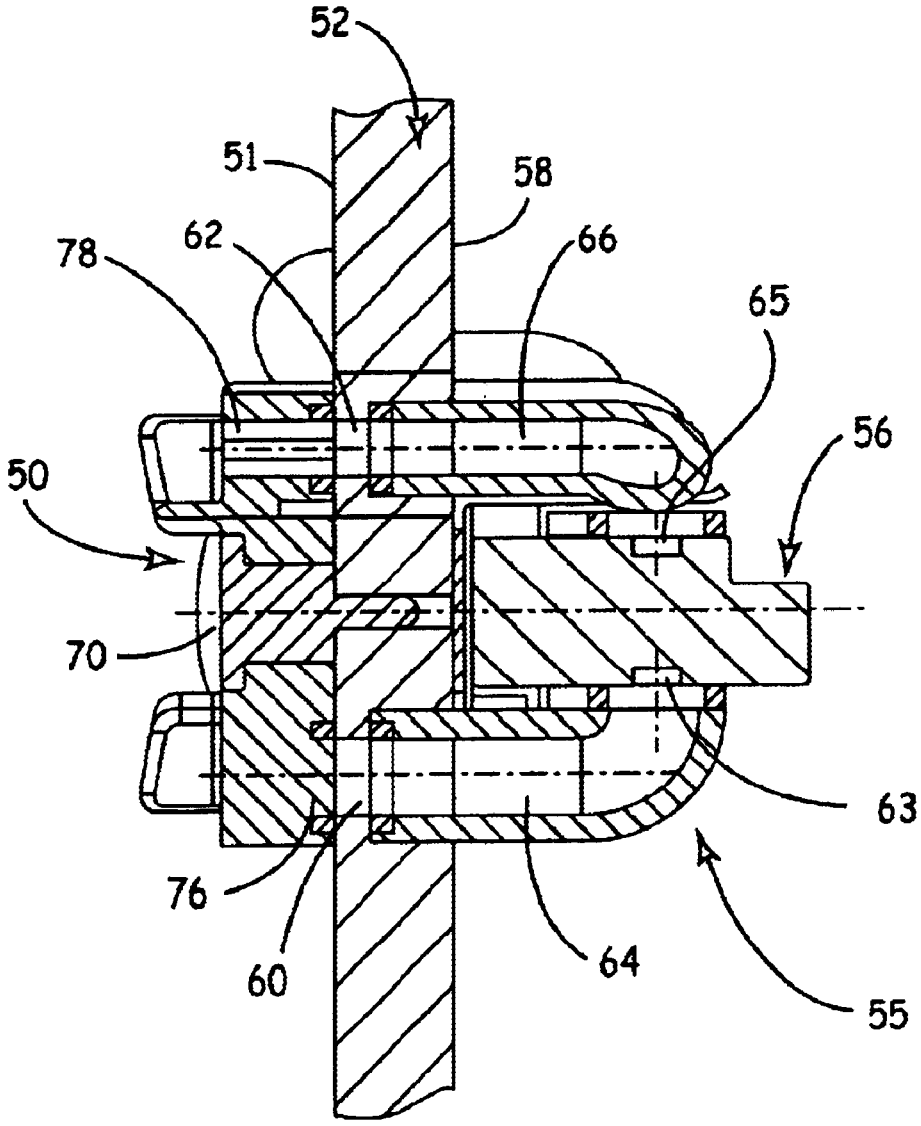
FIG. 6 is a sectional view of the embodiment of the present invention along the section line F—F of FIG. 4.

Referring to FIG. 6, the microphone 56 includes a first acoustic port 63 in an acoustic relationship with the first acoustic passage 64. The microphone 56 also includes a second acoustic port 65, separated by a diaphragm (not shown) from the acoustic port 63, wherein the second acoustic port 65 is in an acoustic relationship with the acoustic passage 66.

The acoustic passages 64 and 66 extend into the acoustic opening 60 and 62 the faceplate 52. The acoustic openings 60 and 62 are of a size that accommodate and engage an outside surface of the acoustic passages 64 and 66. The acoustic openings 60 and 62 frictionally retain the acoustic passages 64 and 66 within the acoustic openings 60 and 62, respectively. The acoustic openings 60 and 62 are larger in diameter on the surface 58 then on the surface 51, as best illustrated in FIG. 6. Because the acoustic openings 60 and 62 have a smaller diameter proximate the surface 51 than the diameter of the acoustic passages 64 and 66, the acoustic passages 64 and 66 are prevented from extending through the faceplate 52.

The switching mechanism 50 is rotatably secured to the outside surface 51 of the faceplate 52 by a pin 70 as best illustrated in FIGS. 1, 2, 3, 5 and 6. The pin 70 includes a number of ridges 72 which engage a surface 74 defining an aperture that extends through the faceplate 52. It will be appreciated that the surface 74 defining the aperture is equidistant from acoustic openings 60 and 62 which is important in relation to the movement of the switching mechanism 50 to acoustically switch between a directional and an omni-directional mode of the hearing aid.

As best illustrated in FIG. 1, the switching mechanism 50 has directional acoustic openings 76 and 78 positioned equidistant from the center of the switching mechanism 50 or the pin 70 and positioned to overlie the acoustic openings 60 and 62 of the faceplate 52. The switching mechanism 50 also includes an omni-directional acoustic opening 80 which is positioned to overlie either acoustic opening 60 or 62 depending on how the switching mechanism 50 is attached to the faceplate 52.

Figure 4:
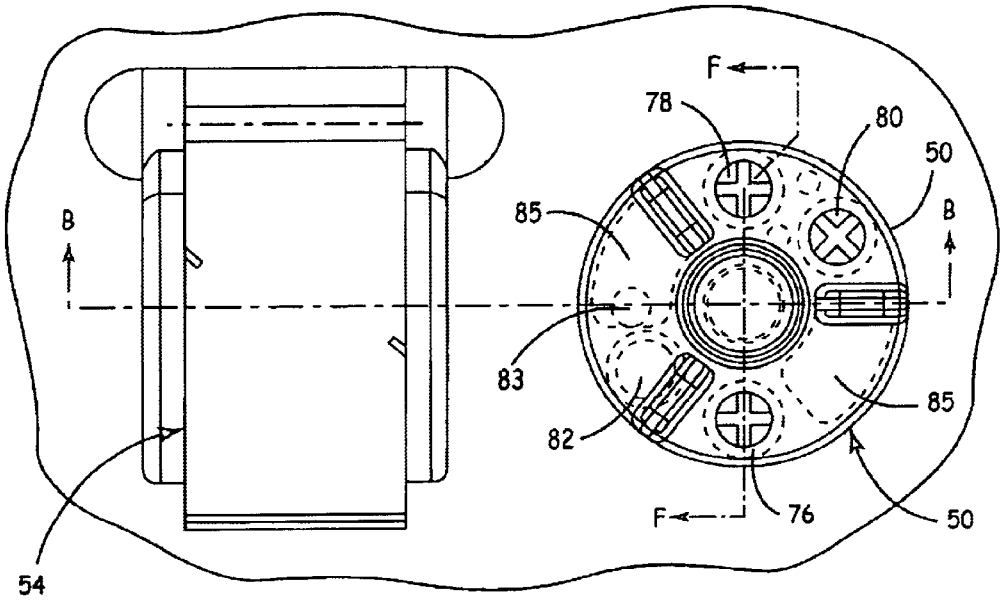
FIG. 4 is a top view of the embodiment of the present invention.

As best illustrated in FIGS. 3 and 4, directly across from the acoustic opening 80 is positioned an acoustic blocking element 82 for directly overlying one of the acoustic openings 60 or 62 of the faceplate 52 when the switching element is positioned in the omni-directional mode, that is when the acoustic opening 80 overlies one of the acoustic openings 60 or 62.

O-ring seals 67 are attached to the underside of the switching mechanism 50 for providing an acoustically tight seal for the directional acoustic openings 76 and 78, the omni-directional opening 80 and the acoustical blocking element 82, as best illustrated in FIG. 3.

Figure 5:
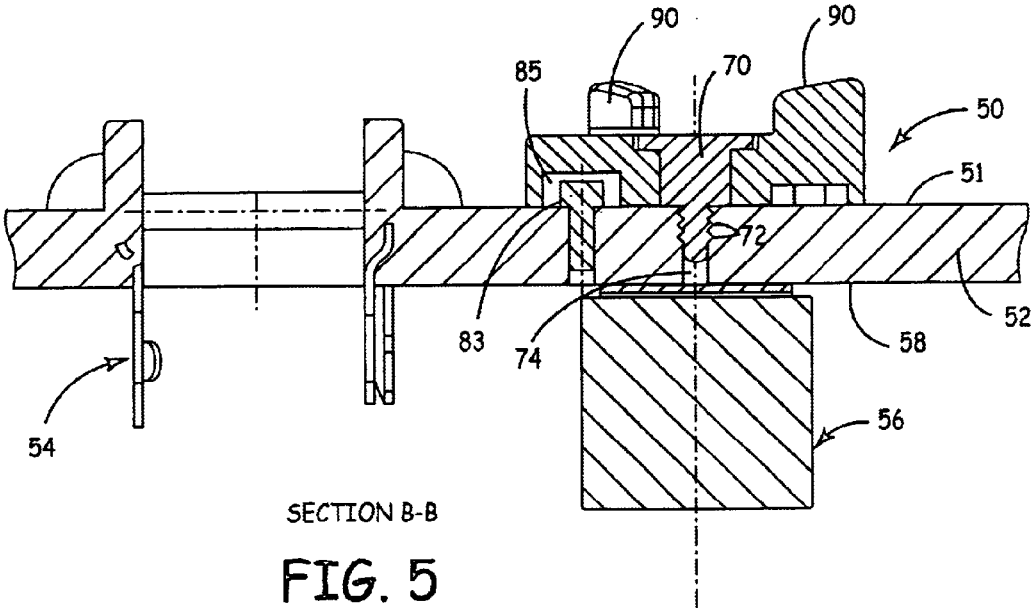
FIG. 5 is a sectional view of the embodiment of the present invention along the section line B—B of FIG. 4.

A stop pin 83 is fixedly attached to the faceplate 52 by frictionally fitting the stop pin 83 into an opening 84 in the faceplate 52. The switching mechanism 50 also includes stop member engaging cavities 85 positioned on an underside thereof, one of which overlies the stop member 83, as best illustrated in FIGS. 4 and 5. The inside surfaces of the cavity 85 engage the stop member 83 as the switching mechanism 50 is rotated about the pin member 70. The inside surfaces of the cavities 85 are formed such that when the switching mechanism 50 is rotated into a first position, the inside surface of one end of the cavity 85 engages the stop pin 83. With the switching mechanism 50 in the first position, both directional acoustic openings 76 and 78 are positioned to directly overlie acoustic openings 60 and 62 thereby placing the openings 76 and 78 in an acoustic relationship with acoustic passages 64 and 66 of the microphone construction 55 and place the microphone 56 in a directional mode.

Likewise, when the switching mechanism 50 is rotated in an opposite direction and thereby positioning the switching mechanism 50 into a second position, the stop pin 83 engages an opposite surface of the cavity 85 thereby aligning the omni-directional opening 80 over either acoustic opening 60 or 62 in the faceplate 52 and the acoustic blocking element 82 over the other acoustic opening 60 or 62 to place the microphone 56 in an omni-directional mode. A plurality of tab members 90 extend outwardly from the switching mechanism 50 to aid in rotating the switching mechanism 50 through use of a finger or a tool.

Figure 10:
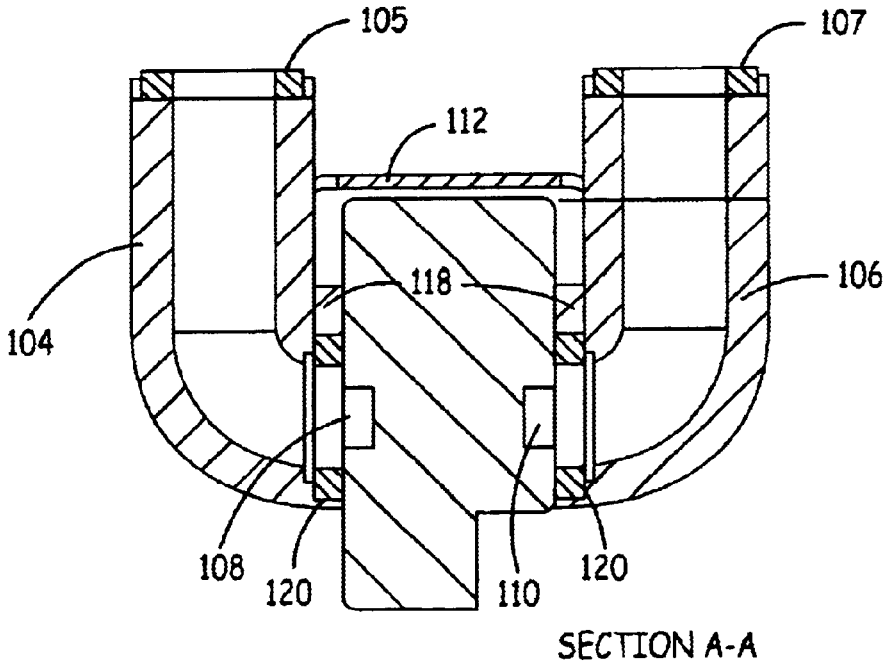
FIG. 10 is a sectional view of the first alternative embodiment of the microphone construction of the present invention along the section line A—A of FIG. 9.
Figure 11:
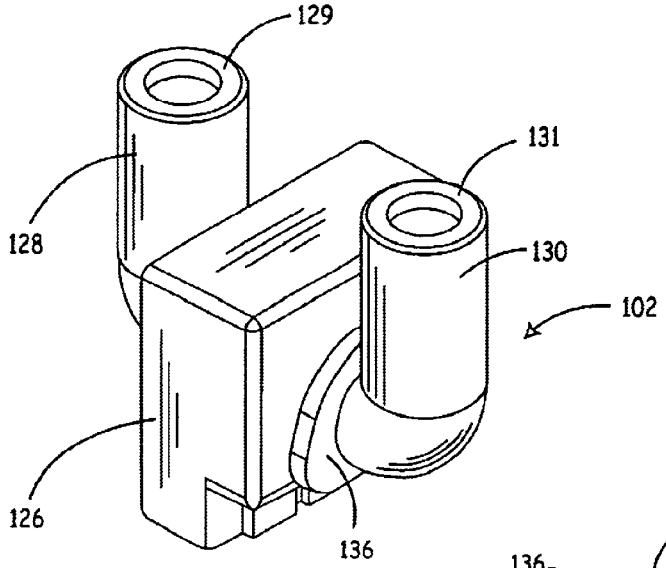
FIG. 11 is a perspective view of a second alternative embodiment of a microphone construction of the present.
Figure 12:
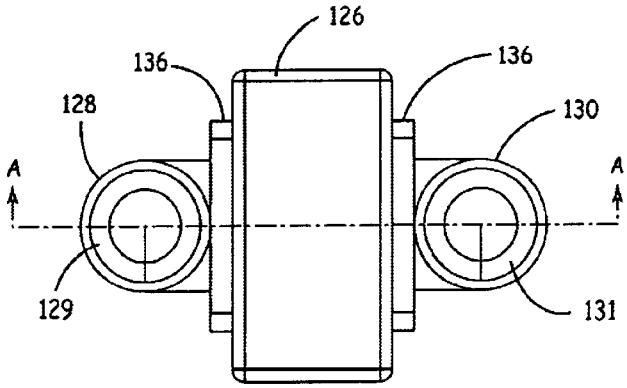
FIG. 12 is a top view of the second alternative embodiment of the microphone construction of the present invention.
Figure 13:
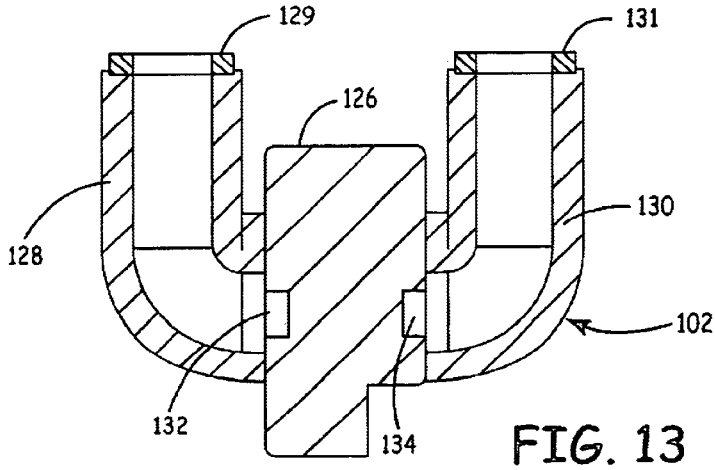
FIG. 13 is a sectional view of the second alternative embodiment of the microphone construction of the present invention along the section line A—A of FIG. 12.
Figure 14:
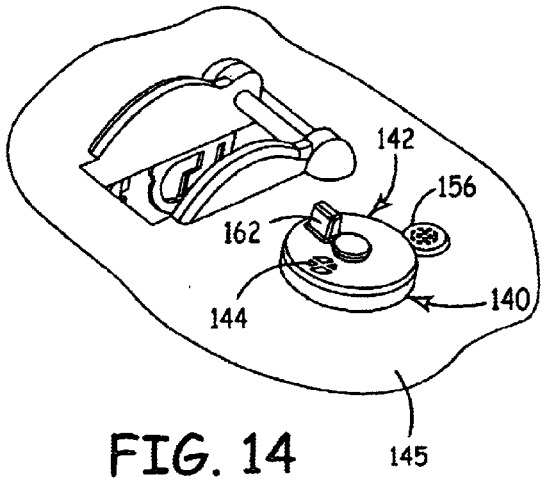
FIG. 14 is a perspective view of a first alternative embodiment of the present invention where a switching mechanism is rotatably secured to a faceplate.

FIGS. 7 through 10 and FIGS. 11 through 13 show alternative embodiments of the microphone construction 55 of FIGS. 1 through 6. With respect to FIGS. 7 through 10, the microphone construction is indicated by reference character 100 while the microphone construction of FIGS. 11 through 13 is generally indicated by reference character 102. Generally speaking, the microphones operate in a like manner, and it is their construction that is slightly different.

Figure 7:
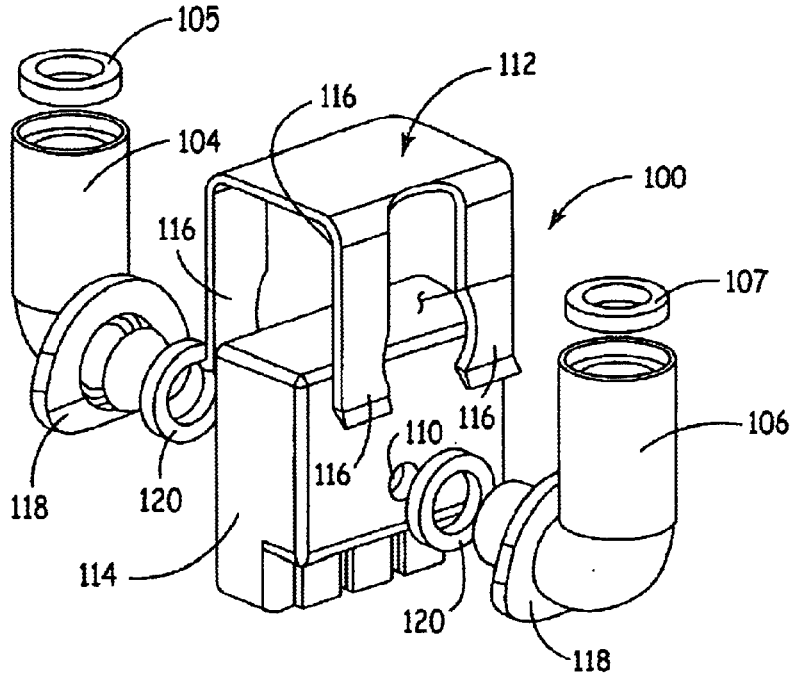
FIG. 7 is an exploded perspective view of a first alternative embodiment of a microphone construction of the present invention.

With respect to microphone construction 100, acoustic passages 104 and 106 are placed in acoustic relationship with microphone acoustic ports 108 and 110 by a retaining clip 112 as best illustrated in FIG. 10. Referring to FIG. 7, each acoustic passage 106 includes a flange member 118. O-rings 120 are positioned about an end of each of the acoustic passages 104 and 106 adjacent the respective microphone ports 108 and 110 to provide an acoustic seal. Within second ends of the acoustic passages 104 and 106 are recesses which retain a second set of O-rings 105 and 107 which forms a seal with the faceplate 52 when the acoustic passages 104 and 106 are positioned within the acoustic openings 60 and 62.

Figure 8:
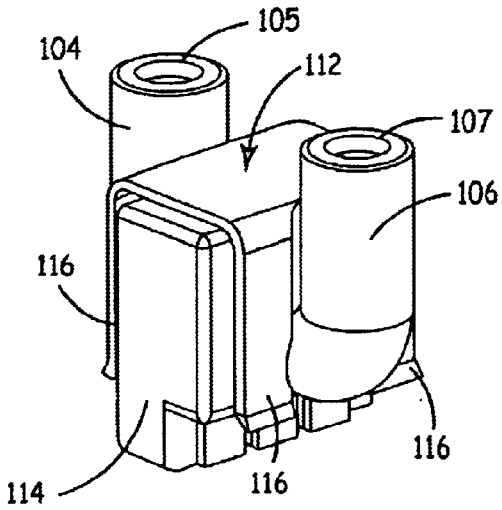
FIG. 8 is a perspective view of the first alternative embodiment of the microphone construction of the present invention.
Figure 9:
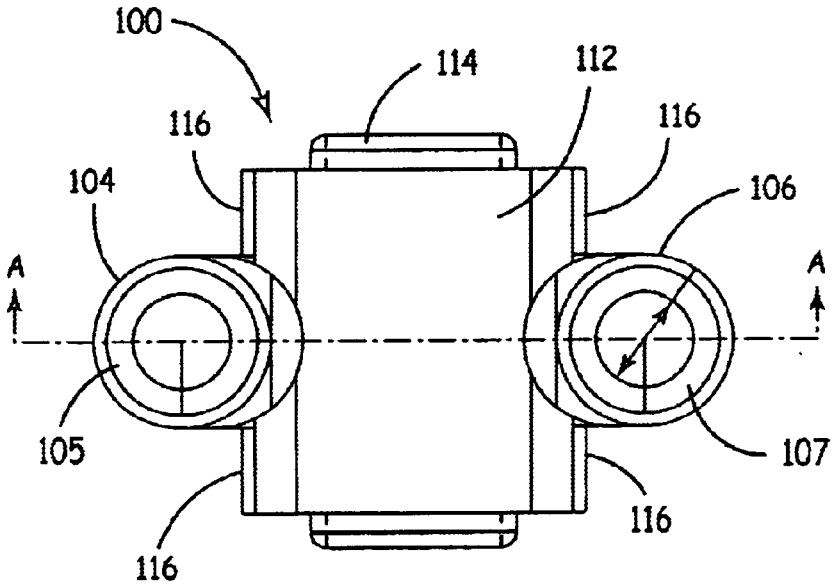
FIG. 9 is a top view of the first alternative embodiment of the microphone construction of the present invention.

The retaining clip 112 has resilient spaced-apart fingers 116 positioned on both sides of the main body 114 of the microphone construction 100. As illustrated in FIGS. 7 and 8, the fingers 116 are positioned on opposite sides of the main body 114 of the microphone and engage the flanges 118 of the acoustic passages 104 and 106.

The embodiment of the microphone construction 102 illustrated in FIGS. 11 through 13 includes a main body 126 to which acoustic passages 128 and 130 are welded in an acoustic relationship with acoustic microphone ports 132 and 134 as best illustrated in FIGS. 11 and 13. The microphone construction 102 of FIGS. 11 through 13 is absent the retaining clip and O-rings of the microphone construction 100. An acoustic seal is provided by welding the passages 128 and 130 to the main body 126. Flanges 136 provide a stable base for welding the acoustic passages 128 and 130 to the main body 126 of the microphone construction 102. O-rings 129 and 131 are positioned within recesses at an end of each of the acoustic passages 128 and 130, respectively. When the acoustic passages 128 and 130 are frictionally fit within the acoustic openings 60 and 62 of the faceplate 52, the O-rings 129 and 131 form an acoustic seal between the acoustic passages 128 and 130 and the faceplate 52.

An alternate embodiment 140 of the present invention is illustrated in FIGS. 14 through 17. The embodiment 140 of FIGS. 14 through 17 includes a rotatable switching mechanism 142 similar to the rotatable switching mechanism 50 illustrated in FIGS. 1 and 6 except that the mechanism 142 includes only one acoustic opening 144. The switching mechanism 142 is rotatably attached to a faceplate 145 in a similar manner as the switching mechanism 50 in FIGS. 1 through 6.

Figure 16:
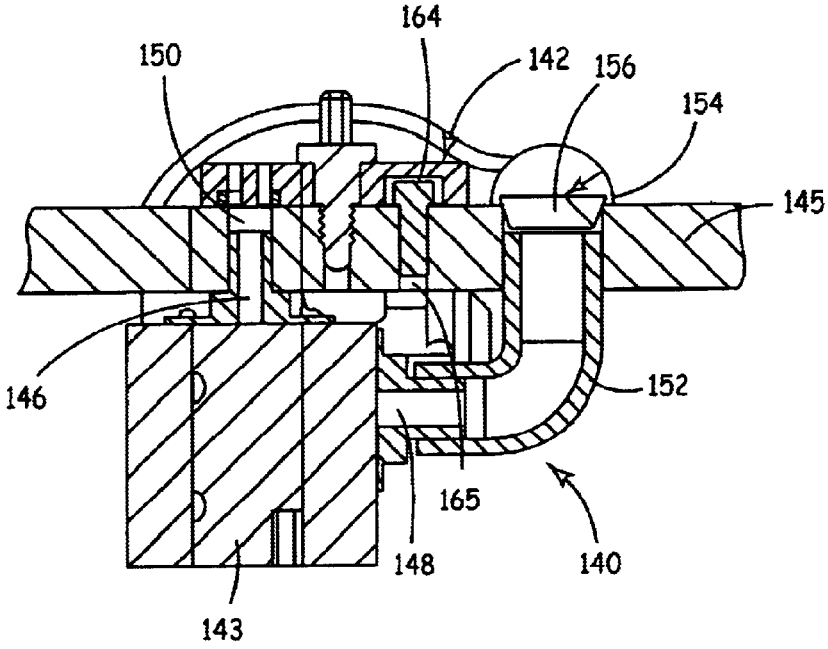
FIG. 16 is a sectional view of the first alterative embodiment of the present invention along the section line A—A of FIG. 15.

As best illustrated in FIG. 16, a directional microphone 143 includes acoustic ports 146 and 148 disposed along axes that are perpendicular to each other. The acoustic port 146 engages an acoustic opening 150 within the faceplate 145 and is positioned beneath the switching element 142. The other acoustic port 148 is connected by an acoustic passage 152 to another acoustic opening 154 within the faceplate 145. The acoustic opening 154 is positioned outside of the perimeter of the switching mechanism 142. A wind screen 156 covers the acoustic opening 154.

Figure 15:
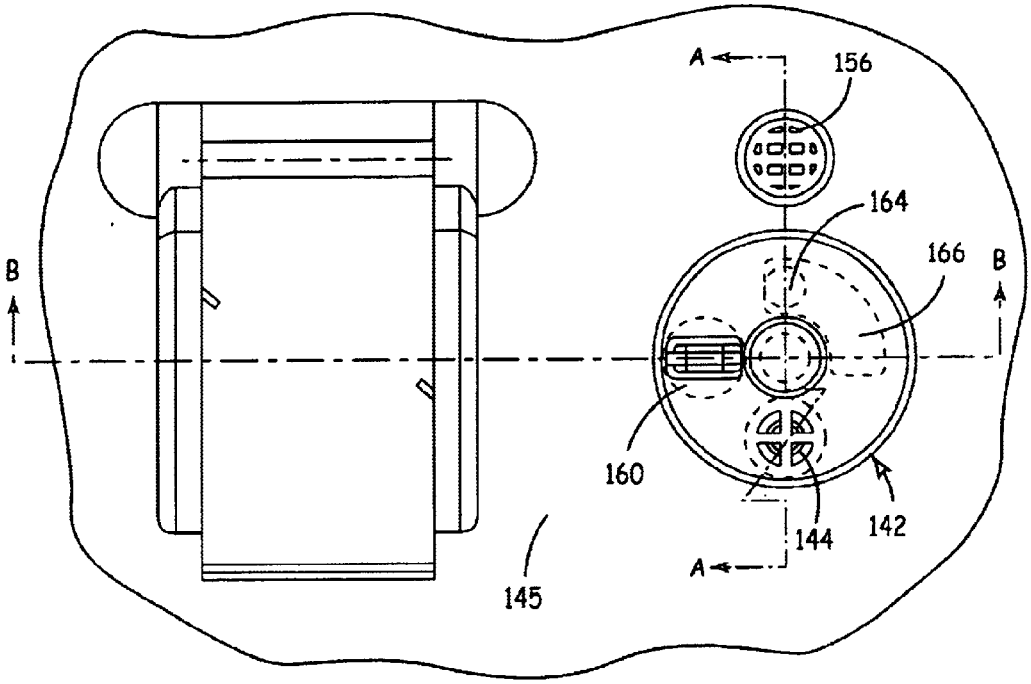
FIG. 15 is a top view of the first alternative embodiment of the present invention.
Figure 17:
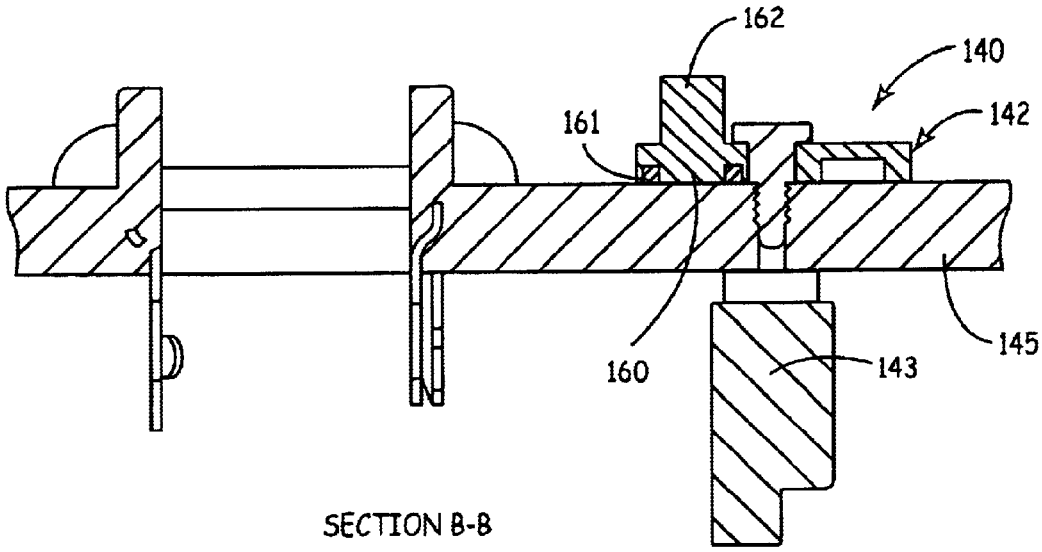
FIG. 17 is a sectional view of the first alternative embodiment of the present invention along the section line B—B of FIG. 15.

Referring to FIGS. 15 and 17, the switching mechanism 142 includes an acoustic blocking element 160 positioned preferably 90 degrees from the acoustic opening 144. In the embodiment 140, the acoustic blocking element 160 is disposed directly beneath an outwardly extending tab member 162. An O-ring 161 is disposed about the blocking element 160 to provide an acoustic seal between the blocking element 160 and the acoustic opening 150.

A stop pin 164 is frictionally fit into a surface 165 defining an aperture within the faceplate 145 as best illustrated in FIGS. 15 and 16. The switching mechanism 142 includes a cavity 166 within which the stop pin 164 is positioned, as best illustrated in FIG. 15. With the stop pin 164 engaging an inside surface of the cavity 166, the acoustic opening 144 of the switching mechanism 142 is positioned over the acoustic opening 150 of the faceplate 145 and is in acoustic relationship with the acoustic port 146 of the microphone 143. In this position, the switching mechanism 142 is positioned into a first position where the microphone 143 is in a directional mode since the other acoustic port 148, of course, is in acoustic relationship with the opening 154 of the faceplate 145.

When the switching mechanism 142 is turned 90 degrees, the stop pin 164 engages an opposite end surface of the cavity 166 thereby positioning the switching mechanism into a second position. With the switching mechanism 142 in the second position, the acoustic blocking element 160 is positioned over the acoustic opening 150 and the acoustic port 146 of the microphone, placing the hearing aid into an omni-directional mode. The O-ring 161 provides an acoustic seal between the switching mechanism 142 and the acoustic opening 150 when the switching mechanism 142 is positioned into the second position.

Figure 20:
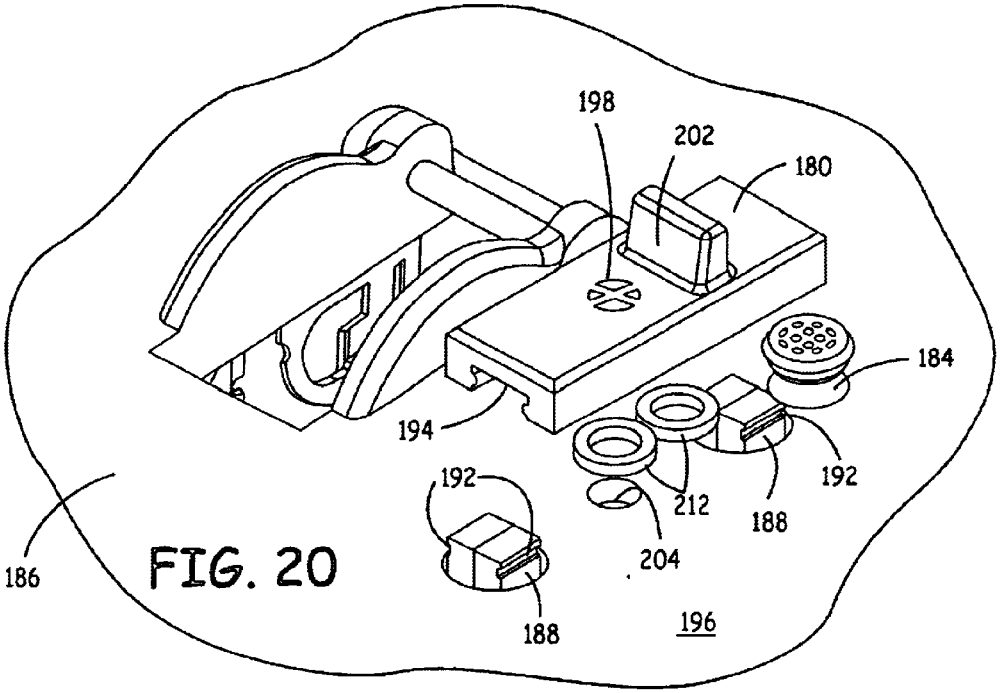
FIG. 20 is an exploded partial perspective of the second alternative embodiment of the present invention as viewed from above.
Figure 21:
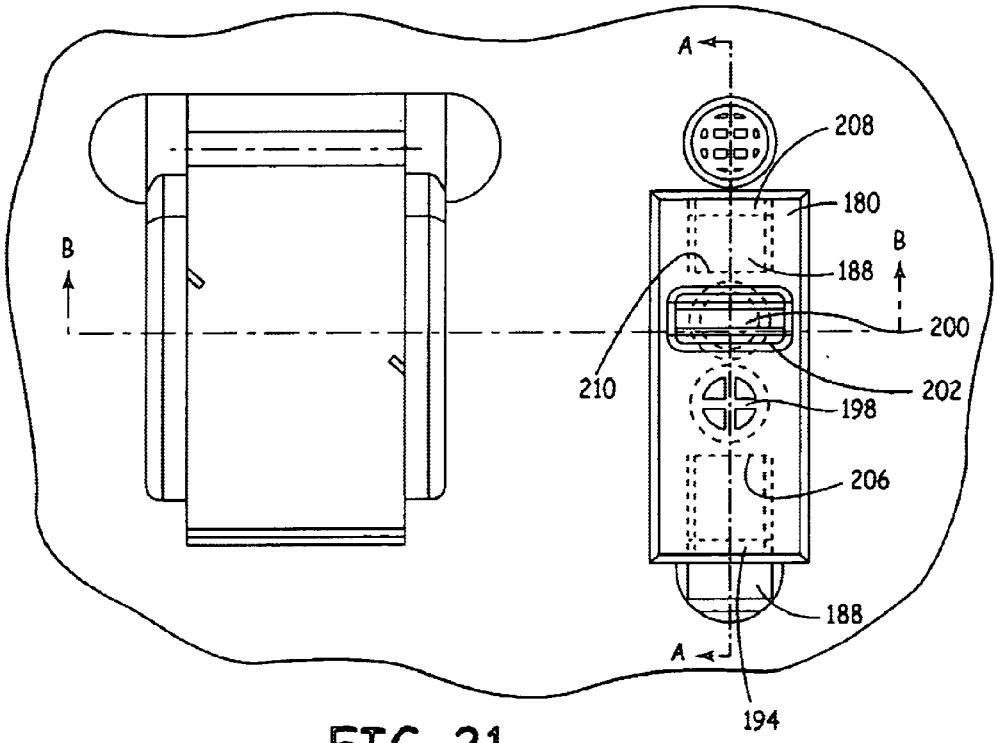
FIG. 21 is a top view of the second alternative embodiment of the present invention.
Figure 22:
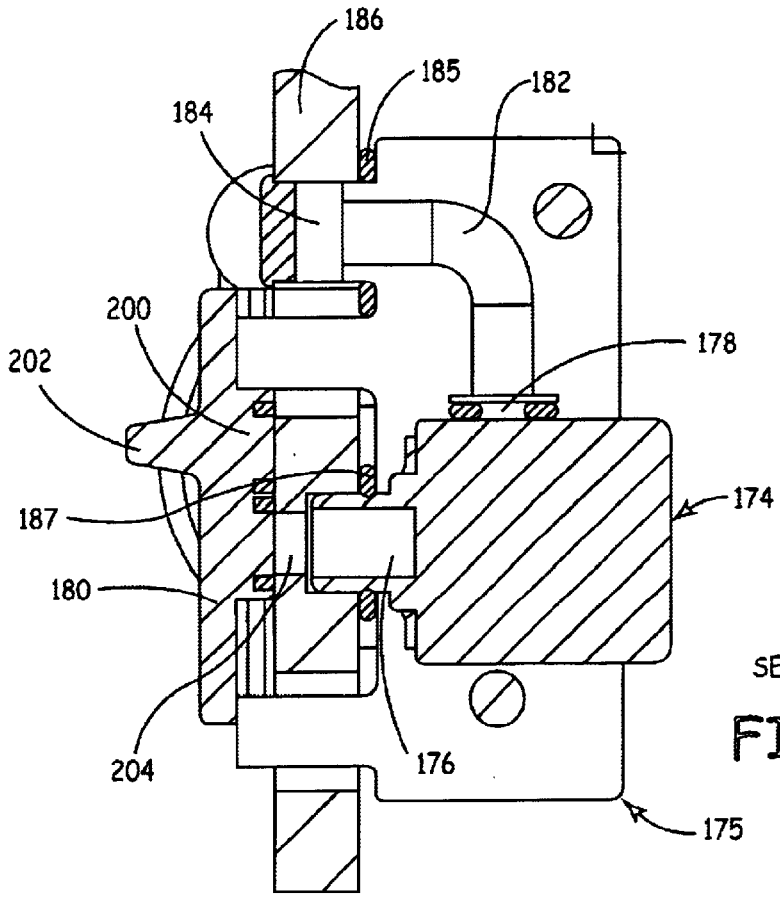
FIG. 22 is a sectional view of the second alternative embodiment of the present invention along the section line A—A of FIG. 21.
Figure 23:
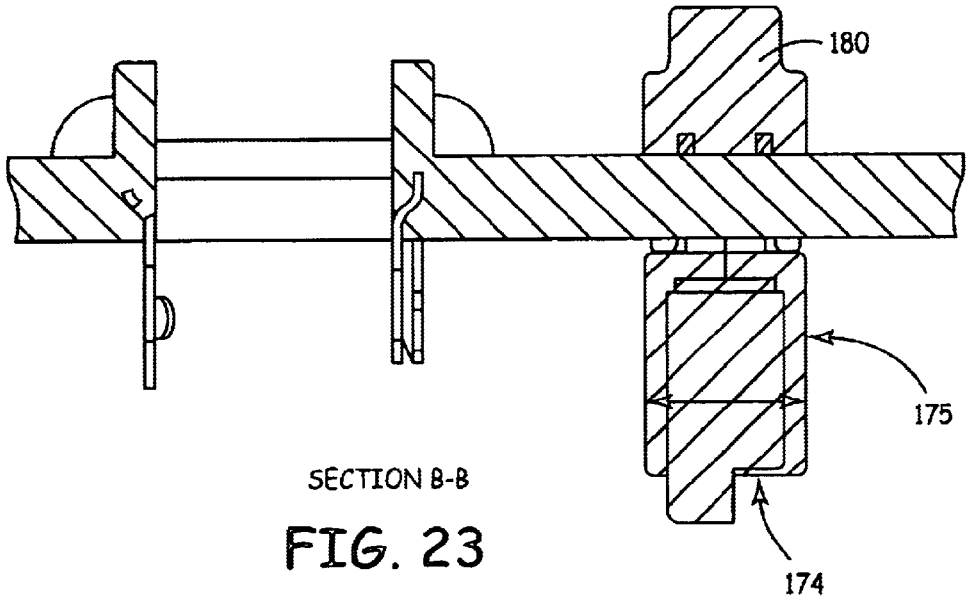
FIG. 23 is a sectional view of the second alternative embodiment of the present invention along the line B—B of FIG. 21.
Figure 24:
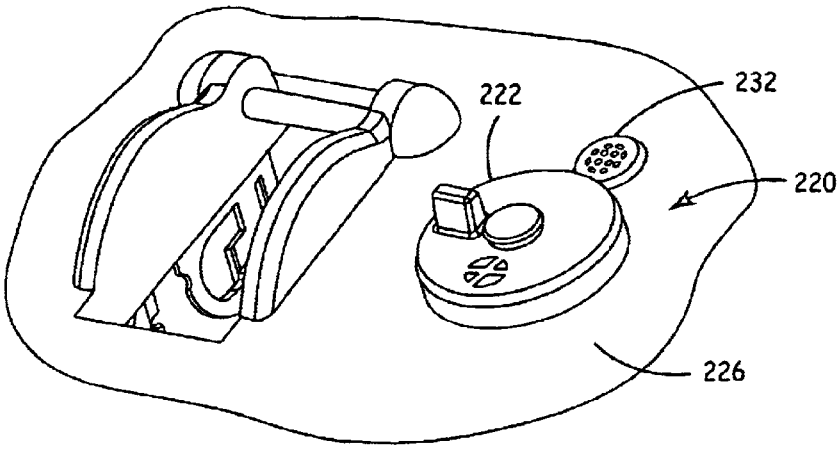
FIG. 24 is a partial perspective view of a third alternative embodiment of the present invention.
Figure 25:
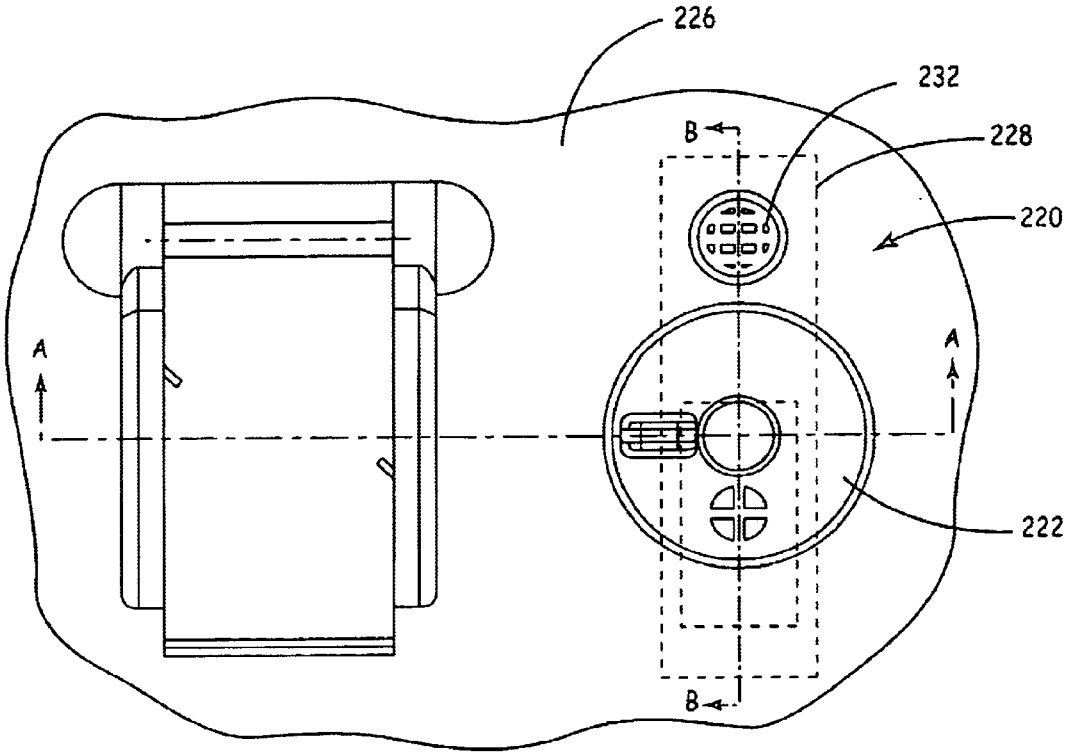
FIG. 25 is a top view of the third alternative embodiment of the present invention.

Another alternate embodiment of the present invention is illustrated in FIGS. 18 through 23. The embodiment 170 is similar in concept to the embodiment 140 illustrated in FIGS. 14 through 17. As best illustrated in FIG. 22, a directional microphone 174 includes acoustic ports 176 and 178 positioned along axes that are perpendicular to each other. The port 176 is disposed beneath a sliding switching mechanism 180 while the port 178 is in an acoustic relationship through an acoustic passage 182 with an acoustic opening 184 in the faceplate 186. The acoustic opening 184 is outside of the travel of the switching mechanism 180 such that the acoustic opening 184 is not covered by the switching mechanism 180 resulting in the acoustic port 178 of the microphone 174 always being in an acoustically receptive state.

Figure 18:
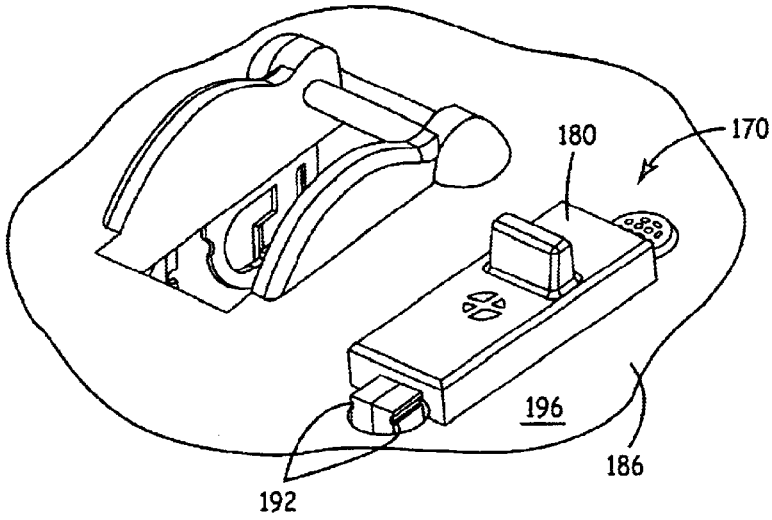
FIG. 18 is a partial perspective view of the a second alternative embodiment of the present invention.
Figure 19:
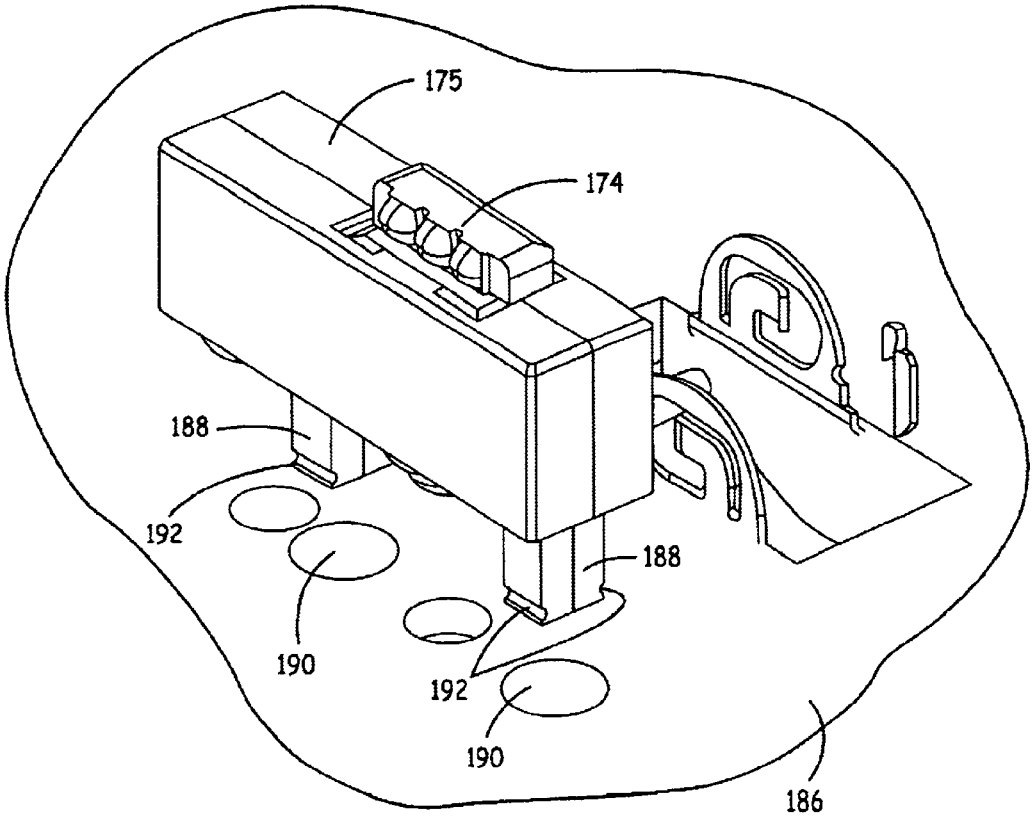
FIG. 19 is an exploded partial perspective view of the second alternative embodiment of the present invention as viewed from below.

The microphone 174 is disposed in a housing 175 that includes a pair of spaced apart posts 188 that extend through openings 190 in the faceplate 186, as best illustrated in FIGS. 19 and 20. The posts 188 have tracks 192 on opposing sides. The switching element 180 has elongated slots 194 and 208 of a size and shape that conform to the tracks 192 at the ends of the posts 188 that extend beyond the outer surface 196 of the faceplate 186, as best illustrated in FIGS. 18 and 21. As can be appreciated, the switching element 180, through its engagement of the ends of the posts 188 that extend above the surface 196, slides along the posts 188 and retains the microphone 174 on the opposite side of the faceplate 186 in a selected position.

Similar to the switching mechanism of FIGS. 14 through 17, the switching mechanism 180 also contains a single acoustic opening 198. The switching mechanism 180 also includes an acoustic blocking element 200 that is positioned directly beneath a tab 202, as best illustrated in FIGS. 21 and 22.

As can be appreciated, the travel of the switching mechanism 180 positions the acoustic opening 198 over the acoustic opening 204 in the faceplate 186, thereby placing the acoustic opening: 198 in acoustic relationship with the acoustic port 176 of the microphone 174. When the acoustic opening 198 is over the acoustic opening 204, the switching mechanism 180 is in a first position. With the switching mechanism 180 in the first position, the microphone 174 is in a directional mode.

The switching mechanism 180 is positioned into a second position when the blocking element 200 is positioned over the acoustic opening 204. With the switching mechanism 180 in the second position, the blocking element 200 blocks the port 176 and places the microphone 174 into an omni-directional mode.

As can best be seen in FIG. 21, the slot 194 has an inside surface 206 and the slot 208 positioned on an opposite end of the switching mechanism 180 has an inside surface 210. It will be appreciated that the travel of the switching mechanism 180 is limited by engagement of the posts 188 between the surfaces 206 and 210 of the slots 194 and 208, respectively. As specifically illustrated in FIG. 21, the travel of the switching mechanism 180 is limited by the inside surface 210, corresponding to the switching mechanism 180 being in the first position, thereby placing the acoustic opening 198 in acoustical relationship with the port 176, and thereby placing the microphone 174 in a directional mode. If the switching mechanism 180 were moved in an opposite direction such that the post 188 would engage the inside surface 206, the switching mechanism 180 would be positioned into the second position wherein the microphone 174 would be placed in an omni-directional mode.

As in the embodiments previously discussed, O-rings 212 are positioned about the acoustic opening 198 and the blocking element 200 such that an acoustic seal is created between the faceplate 186 and the switching mechanism 180 when the switching mechanism 180 is in either the first or second position. Additionally, referring to FIG. 22 an O-ring 185 is positioned between the faceplate 186 and the housing 175 about the opening for the acoustic passage 182 to provide an acoustic seal therebetween. Similarly, an O-ring 187 is positioned between the faceplate 186 and the acoustic port 176 of the microphone to provide an acoustic seal therebetween.

Figure 26:
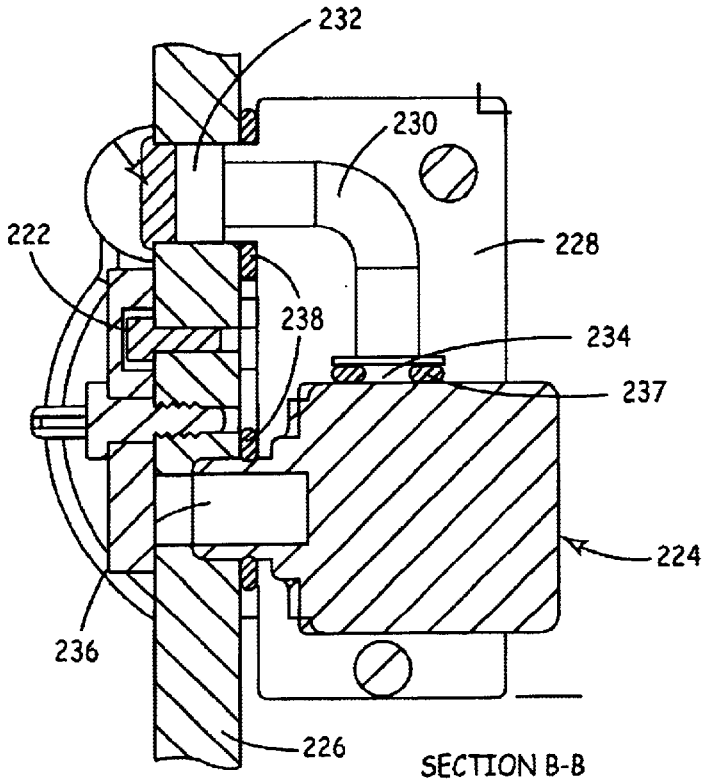
FIG. 26 is a sectional view of the third alternative embodiment of the present invention along the section line B—B of FIG. 25.
Figure 27:
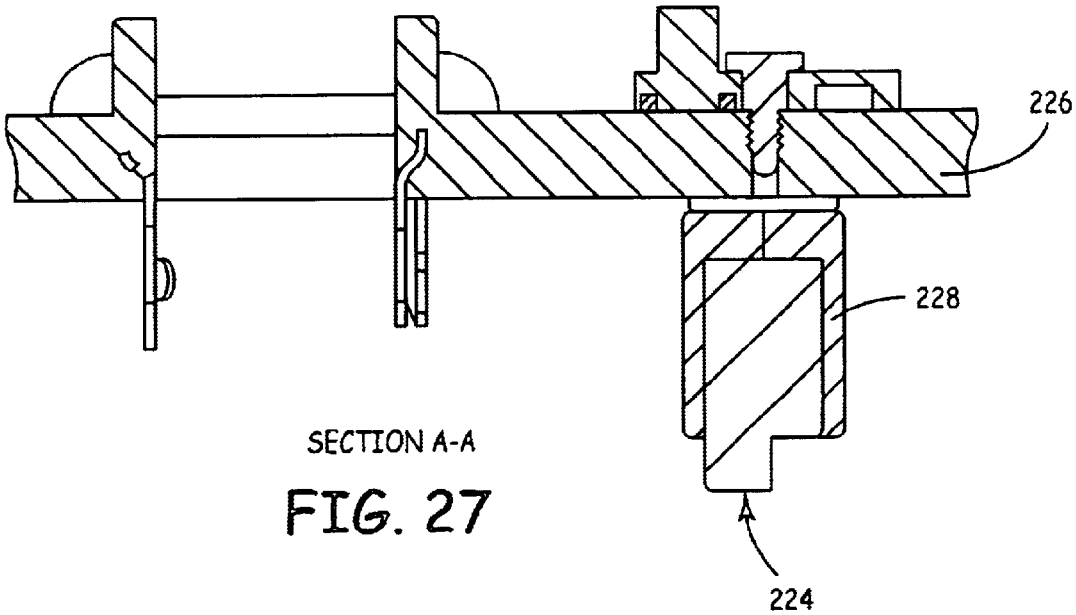
FIG. 27 is a sectional view of the third alternative embodiment of the present invention along the section line A—A of FIG. 25.

An alternate embodiment 220 of the present invention is illustrated in FIGS. 24 through 27. The embodiment 220 is similar to the embodiment illustrated in FIGS. 14 through 17. The embodiment 220 includes a switching mechanism 222 identical to the switching element 142 illustrated in FIGS. 14 through 17. The primary difference between the embodiment 220 and the embodiment 140 is that a directional microphone 224 is retained within a microphone retaining chamber within a retaining block or housing 228, as best illustrated in FIGS. 26 and 27. The retaining block 228 includes an acoustic passage 230 for providing passage of sound waves from an opening 232 in the faceplate 226 to an acoustic port 234 of the microphone 224. The other acoustic port 236 of the microphone 224 is disposed beneath the switching mechanism 222 in a manner that was described with respect to the embodiment as illustrated in FIGS. 14 through 17. O-rings 238 are disposed between an inner surface of the faceplate 226 and the retaining block 228 to provide an acoustic seal between the acoustic port 236 and acoustic passage 230. Additionally, an O-ring 237 provides an acoustic seal between the acoustic port 234 of the microphone 236 and the retaining block 228.

Figure 28:
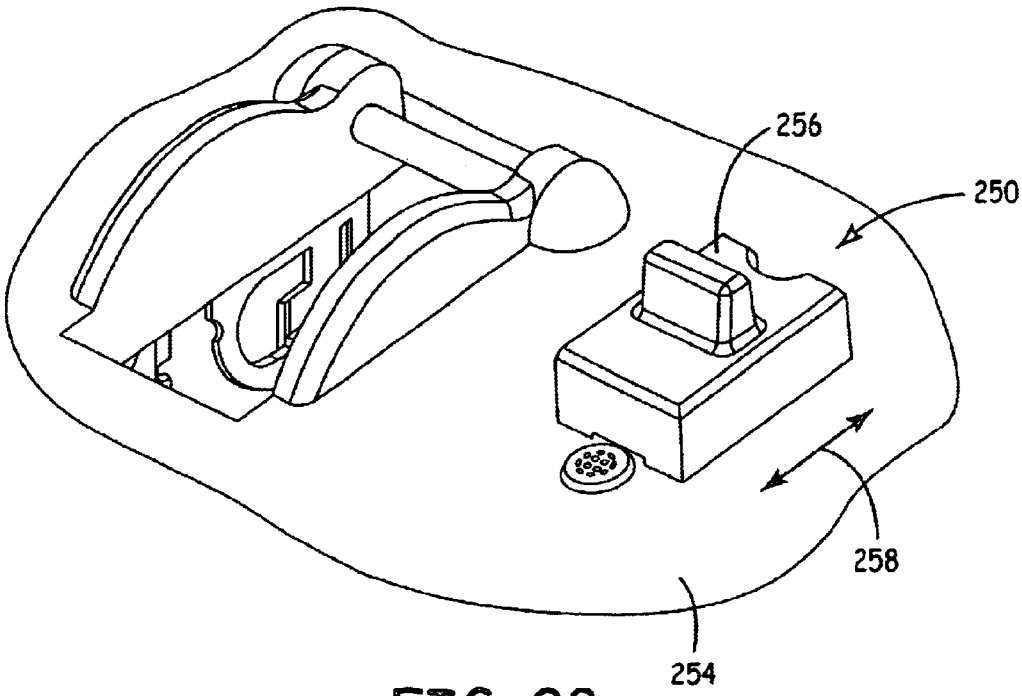
FIG. 28 is a partial perspective view of a fourth alternative embodiment of the present invention.
Figure 29:
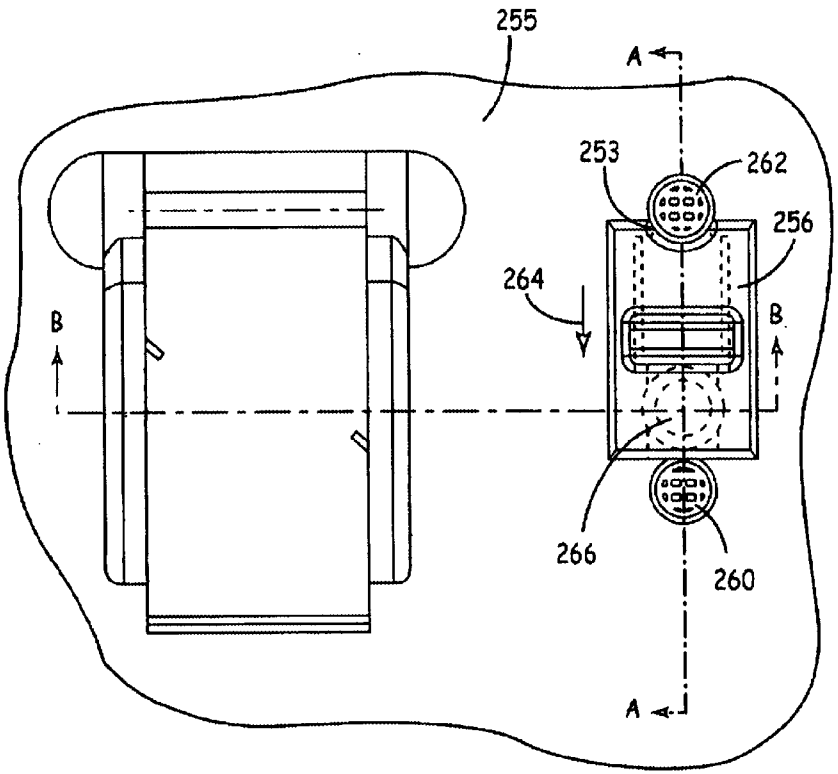
FIG. 29 is a top view of the fourth alternative embodiment of the present invention.
Figure 31:
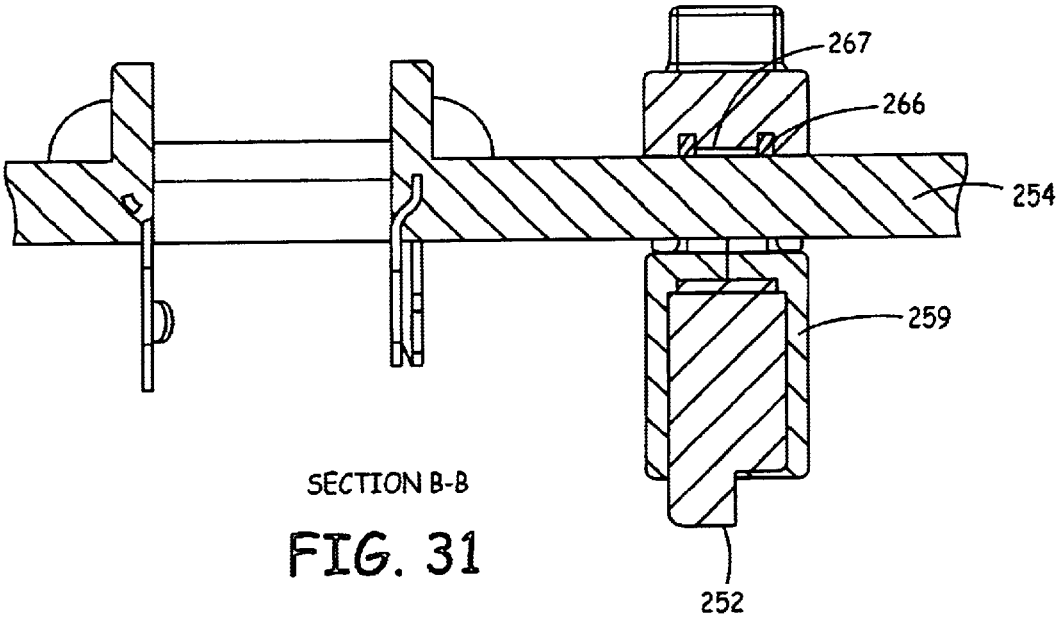
FIG. 31 is a sectional view of the fourth alternative embodiment of the present invention along the section line B—B of FIG. 29.
Figure 32:
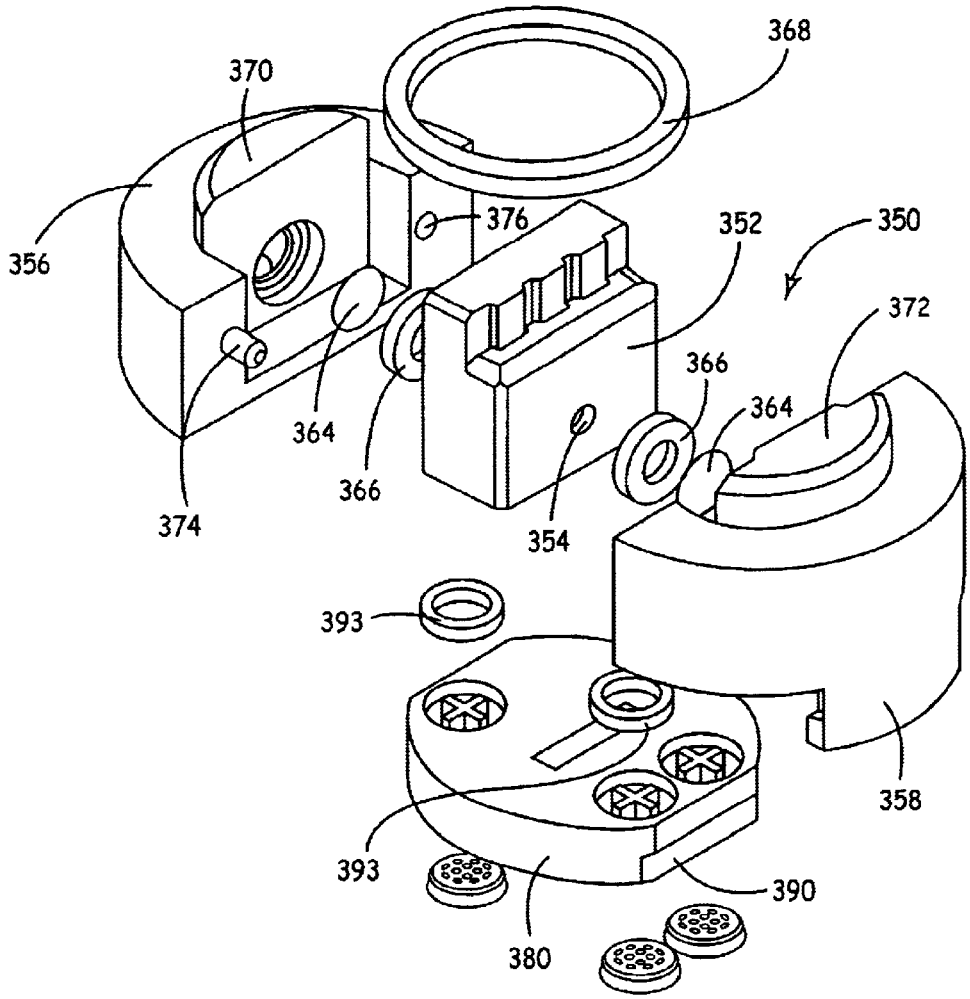
FIG. 32 is an exploded perspective view of a fifth alternative embodiment of the present invention.
Figure 33:
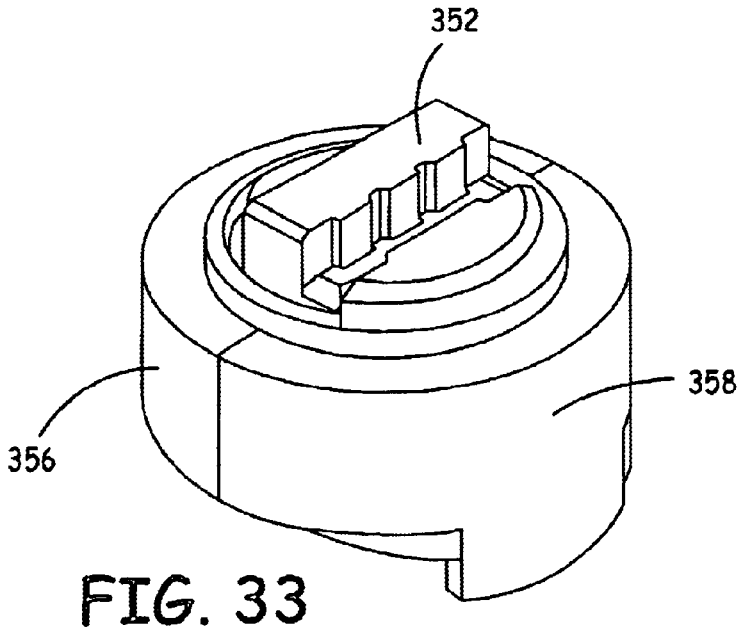
FIG. 33 is a perspective view of the fifth alternative embodiment of the present invention as viewed from above.

Another alternate embodiment 250 of an in-the-ear directional/omni-directional microphone structure of the present invention is illustrated in FIGS. 28 through 31. The embodiment 250 is similar to the embodiment 170 described with respect to FIGS. 18 through 23. The microphone 252 and its securement to a faceplate 254 is very much the same as was described with respect to FIGS. 22 and 23. The difference between embodiment 250 and embodiment 170 is the construction of the switching mechanism 256. The switching mechanism 256 is slidable in a direction of arrows 258 as illustrated in FIG. 28. The difference between the switching mechanism 256 and the switching mechanism 198 is that the switching mechanism 256 does not have an acoustic opening. Instead, both acoustic openings are on the faceplate 254 and are not covered by the switching mechanism 256 when the switching mechanism 256 is in a first position which corresponds to the microphone being in a directional microphone mode, as best illustrated in FIG. 29.

In FIG. 29, an acoustic opening 260 and an acoustic opening 262 are not covered by the switching mechanism 256, thereby placing the microphone 252 in the directional mode. An arcuate recess 253 proximate a first end of the switching mechanism 256 is disposed about the acoustic opening 262 when the switching mechanism 256 is in the first position.

To place the microphone 252 in an omni-directional microphone mode, the switching mechanism 256 is moved in the general direction of arrow 264, and into a second position as illustrated in FIG. 29, thereby placing acoustical blocking element 266 over opening 260, leaving only the acoustic opening 262 uncovered to accept sound waves. With the switching mechanism 256 in the second position, the microphone 252 is in an omni-directional mode.

Figure 30:
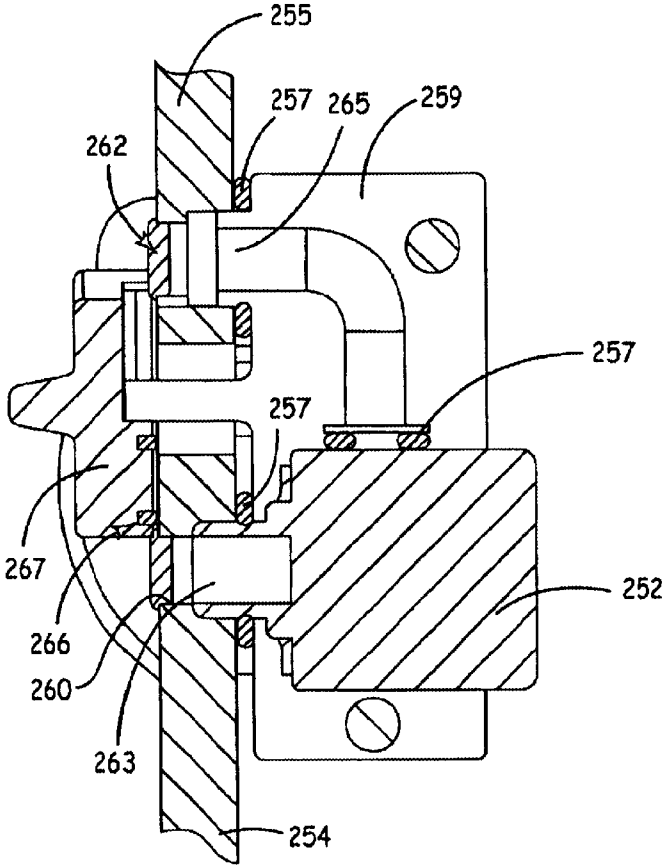
FIG. 30 is a sectional view of a fourth alternative embodiment of the present invention along the section line A—A of FIG. 29.

Referring to FIG. 30, O-rings 257 are positioned between the faceplate 255 and the housing 259 to form an acoustic seal between the housing 259 and the faceplate 255 about an acoustic port 263 and the acoustic passage 265. An O-ring 266 is positioned about a blocking port 267 to form an acoustic seal about the acoustic opening 260 when the switching mechanism 256 is positioned into the second position. Additionally, an O-ring 257 is positioned about the acoustic passage 265 and the microphone 252 to provide an acoustic seal therebetween.

Figure 36:
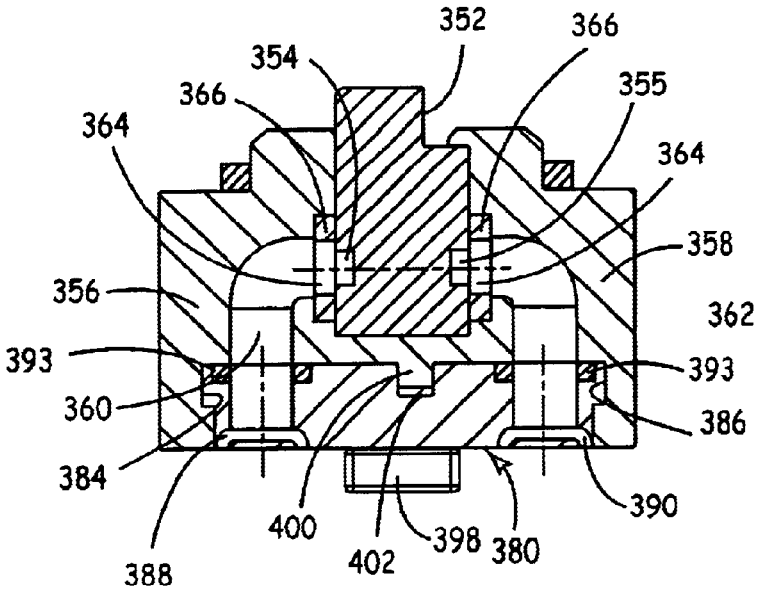
FIG. 36 is a sectional view of the fifth alternative embodiment of the present invention along the section line A—A of FIG. 35.
Figure 37:
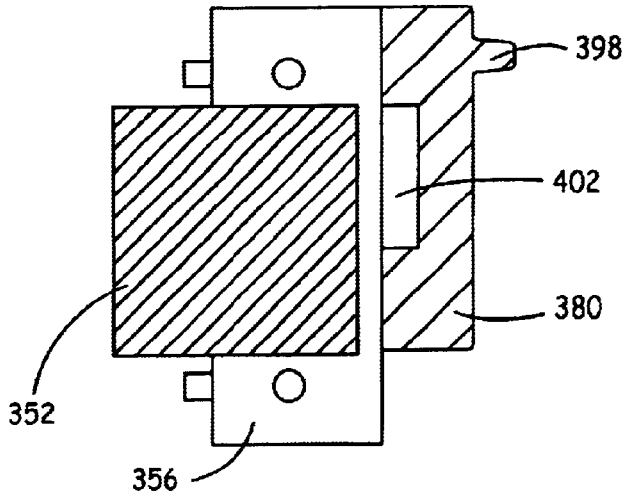
FIG. 37 is a sectional view of the fifth alternative embodiment of the present invention along the sectional line B—B of FIG. 35.

Another alternative embodiment 350 of an in-the-ear omni-directional/directional microphone is illustrated in FIGS. 32 through 39. The embodiment 350 includes a directional microphone 352 having acoustic ports 354 and 355 positioned on opposing sides of a diaphragm (not shown) as best illustrated in FIG. 36. Housing halves 356 and 358 are secured to each other with the microphone 352 disposed therebetween. Each housing half 356 and 358 includes acoustic passages 360 and 362, respectively, as best illustrated in FIG. 36. Acoustic dampers 364 and O-rings 366 are included to provide an acoustical seal between the acoustic passages 360 and 362 and the acoustic ports 354 and 355 of the microphone 352. A retaining ring 368 engages collar halves 370 and 372 of housing halves 356 and 358, respectively, to retain the housing halves 356 and 358 together. Each housing half 356 and 358 also includes a pin member 374 and a surface 376 defining an aperture for receiving the pin member 374 of the opposing housing half to aid in retaining the housing halves together to form a single housing.

Figure 34:
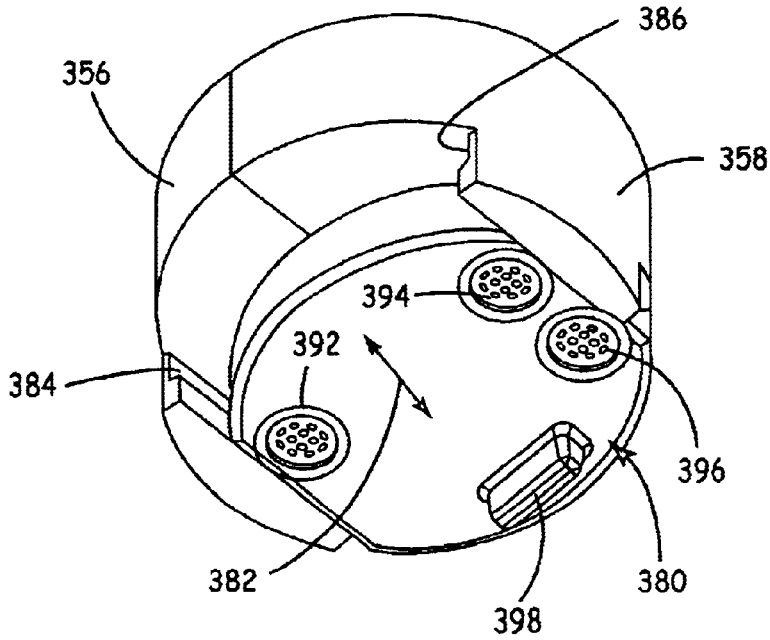
FIG. 34 is a perspective view of the fifth alternative embodiment of the present invention as viewed from below.
Figure 35:
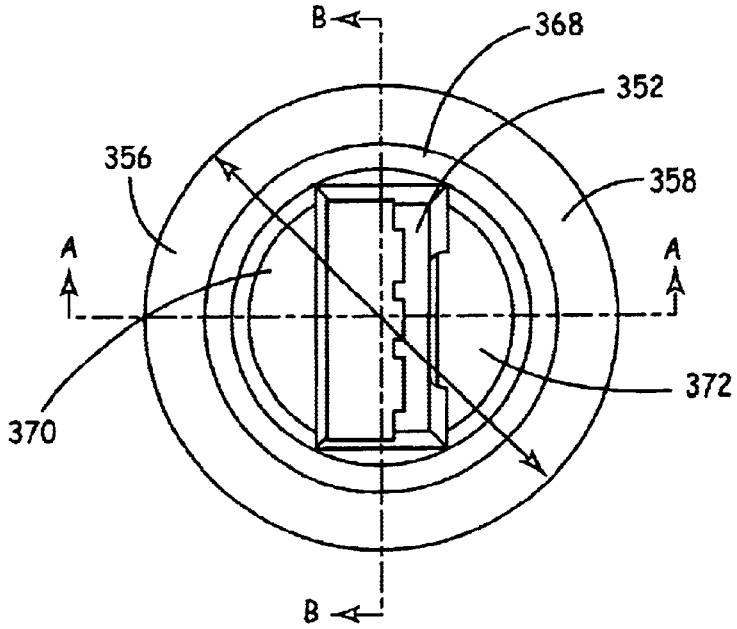
FIG. 35 is a top view of the fifth alternative embodiment of the present invention.

A switching mechanism 380 is attached to the attached housing halves 356 and 358 and is slidable in a direction generally indicated by arrows 382 as illustrated in FIG. 34. Each housing half 356 and 358 includes an inwardly facing elongated track member 384 and 386 that engages conforming track members 388 and 390, respectively, of the switching element 380, as best illustrated in FIGS. 34 and 38.

Figure 38:
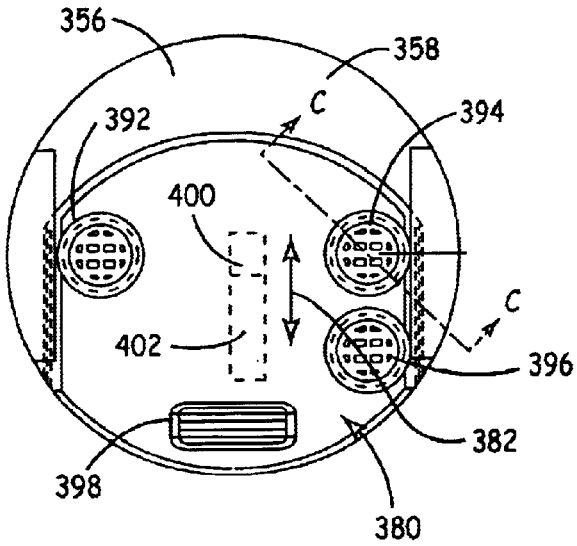
FIG. 38 is a bottom view of the fifth alternative embodiment of the present invention.
Figure 39:
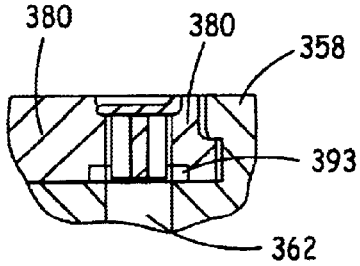
FIG. 39 is a sectional view of the acoustical port in the fifth alternative embodiment of present invention along the section line C—C of FIG. 38.

The switching mechanism 380 is positioned into a first position when acoustic openings 392 and 394 within the switching mechanism 380 are positioned to be in acoustic relationship with acoustic passages 360 and 362, placing the microphone construction in a directional mode as best illustrated in FIG. 38. The switching mechanism 380 is positioned into a second position when an acoustic opening 396 is positioned over acoustic passage 362 and the switching mechanism 380 blocks passage 360, placing the microphone 352 in an omni-directional mode. A tab member 398 is included to aid in moving the switching mechanism 380 between the first and second positions corresponding to the microphone being in a directional or omni-directional mode.

The position of the switching mechanism 380 is determined by a stop member 400 extending from the housing half 358 into a cavity 402 within the switching mechanism 380, as best illustrated in FIGS. 36 and 38. As can best be seen in FIG. 38, the travel of the switching mechanism 380, in a general direction of arrows 382, is determined by the stop member 400 engaging end walls of the cavity 402. Moving the switching mechanism 380 so that the stop member 400 engages one end wall positions the switching mechanism 380 into the first position and places acoustic openings 392 and 394 in acoustic relationship with acoustic passages 360 and 362 which places the microphone 352 in a directional mode. Referring to FIG. 36, O-rings 393 positioned within the acoustic openings 392 and 394 ensure an acoustic seal between the switching mechanism 380 and the housing.

Referring to FIG. 38, moving the switching mechanism 380 in the other direction of arrows 382 will engage an opposite wall of the cavity 402 thereby placing the switching mechanism 380 into a second position which positions the acoustic opening 396 over the acoustic passage 362 while blocking the acoustic passage 360 to place the microphone 352 in an omni-directional mode. An O-ring (not shown) is positioned within the acoustic opening 396 to form an acoustic seal between the switching mechanism 380 and the housing.

Figure 40:
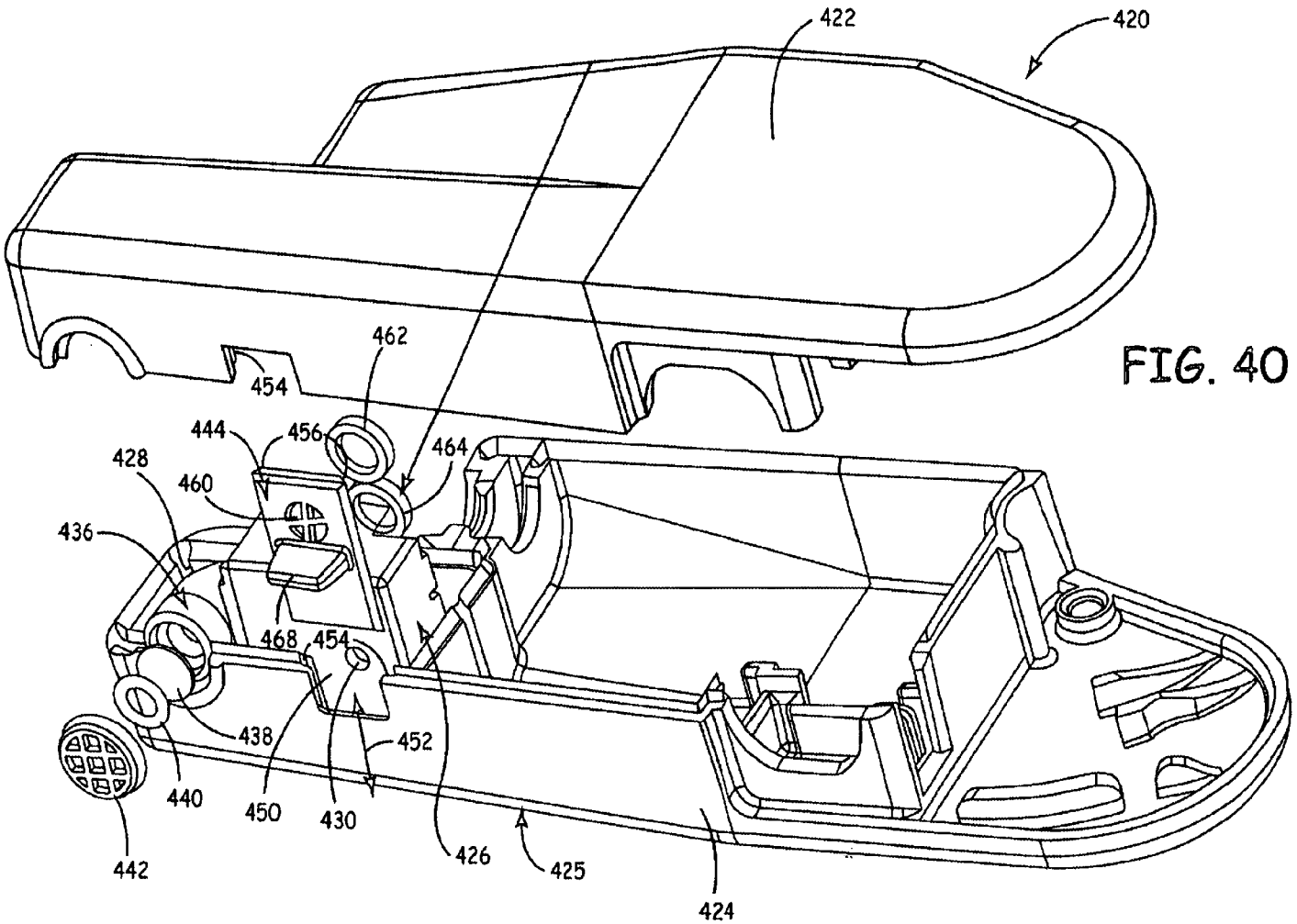
FIG. 40 is an exploded perspective view of a sixth alternative embodiment of the present invention where the invention is a behind the ear hearing aid.
Figure 41:
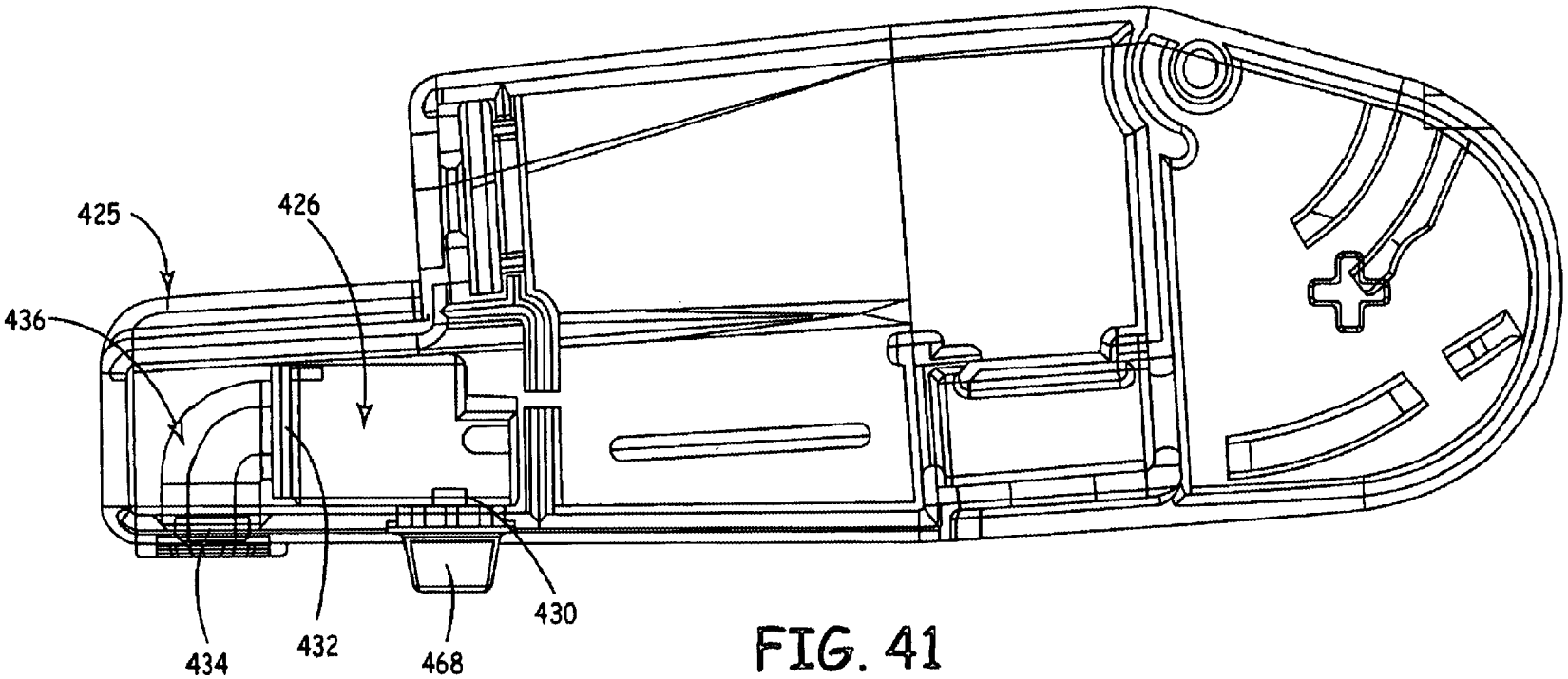
FIG. 41 is a top view of a housing half of the sixth alternative embodiment of the present invention.
Figure 44:
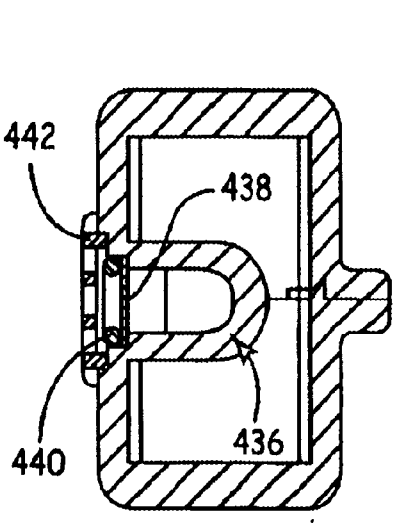
FIG. 44 is a sectional view of the sixth alternative embodiment of the present invention along the section line B—B of FIG. 42.

FIGS. 40 through 44 illustrate a behind-the-ear (BTE) hearing aid housing with an omni-directional/directional microphone construction. The embodiment 420 illustrated in FIG. 40 includes a top housing half 422 and a bottom housing half 424 that are joined together to make a single unitary housing 425 for housing various components of a behind-the-ear hearing aid including the microphone construction. A directional microphone 426 is positioned in a compartment 428. The directional microphone 426 includes two acoustic ports 430 and 432, as best illustrated in FIG. 41. The acoustic port 432 is acoustically connected to an opening 434 in the housing 425 by an acoustic passage 436. A damper screen 438 and an O-ring 440 are positioned at the outlet of acoustical passage 436 along with a wind screen 442 as best illustrated in FIGS. 40 and 44.

Referring to FIG. 40, a switching mechanism 444 is slidably secured within the housing 425 to slide within an acoustic opening 450 in a general direction indicated by arrows 452. The switching mechanism 444 is secured to the housing 425 through the use of grooves 454 disposed along inwardly facing edge surfaces that meet with tracks 456 disposed along opposing edge surfaces of the switching element 444.

Figure 43:
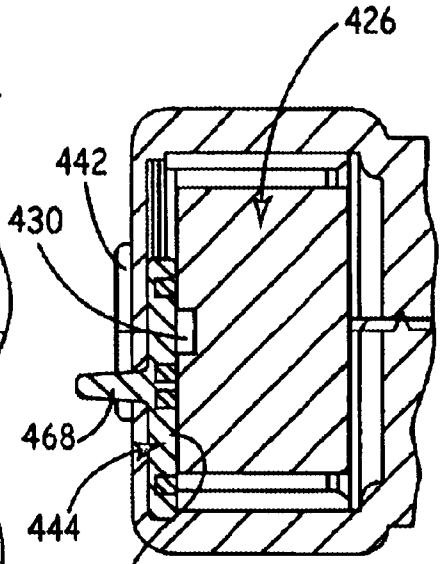
FIG. 43 is a sectional view of the sixth alternative embodiment of the present invention along the section line A—A of FIG. 42.
Figure 42:
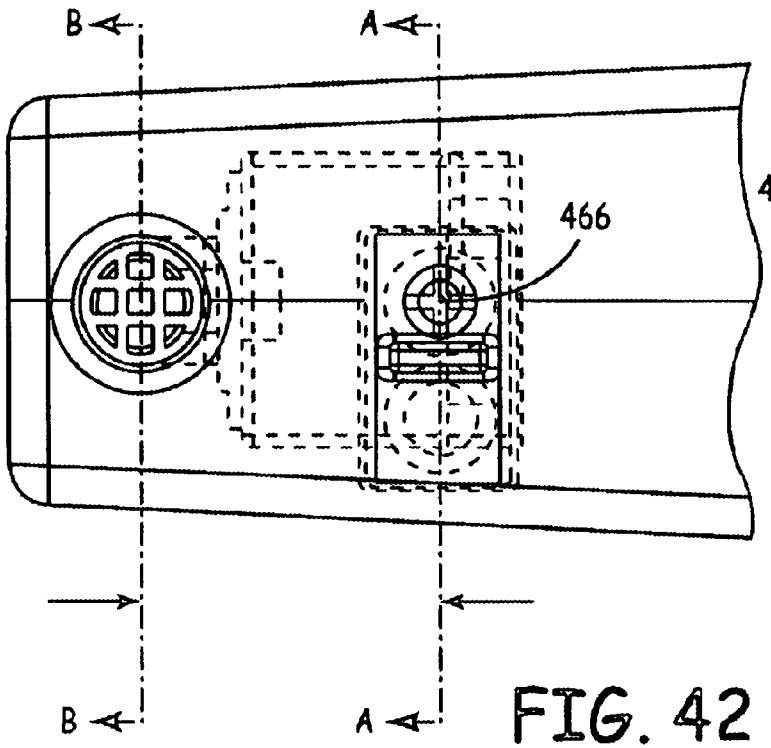
FIG. 42 is a partial side view of the sixth alternative embodiment of the present invention.
Figure 45:
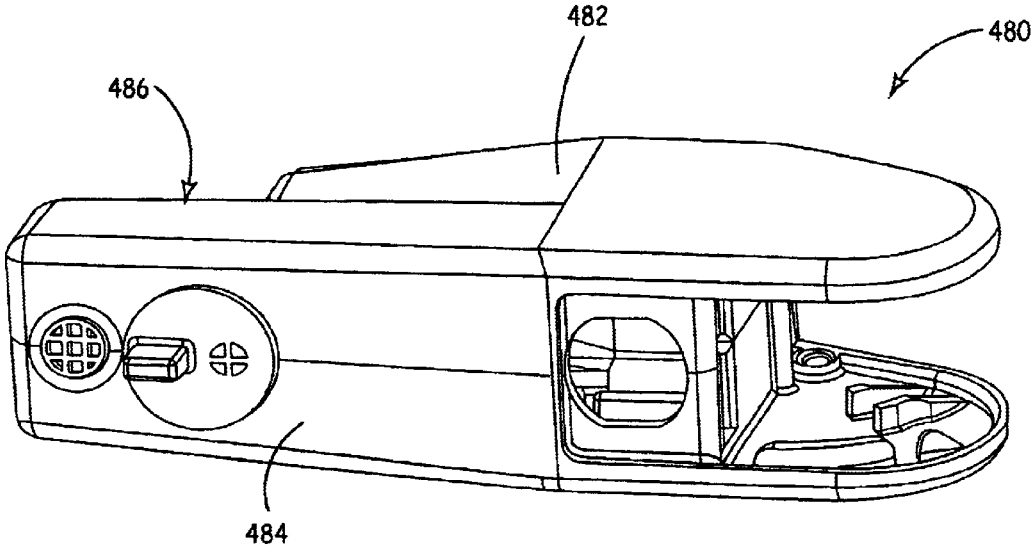
FIG. 45 is a perspective view of a seventh alternative embodiment of the present invention where the embodiment is a behind the ear hearing aid.

The switching mechanism 444 includes an acoustic opening 460 which is combined with an O-ring 462 such that when the acoustic opening 460 is positioned over the acoustic port 430 an acoustic seal is created. A second O-ring 464 is positioned over an acoustic blocking element 466, as best illustrated in FIGS. 42 and 43, to provide an acoustic seal when the blocking element 466 is positioned over the acoustic port 430. An outwardly extending tab member 468 permits the user to easily move the switching mechanism 444 in a general direction indicated by arrow 452.

When the acoustic opening 460 of the switching mechanism 444 is positioned over the acoustic port 430, the switching mechanism 444 is in a first position where the microphone 426 is in a directional mode since both acoustic ports 430 and 432 can receive sound waves. When the switching element 444 is positioned into a second position the acoustic blocking element 466 is positioned over the port 430, such that only the port 432 receives sound waves, thereby placing the microphone construction in an omni-directional mode.

Figure 46:
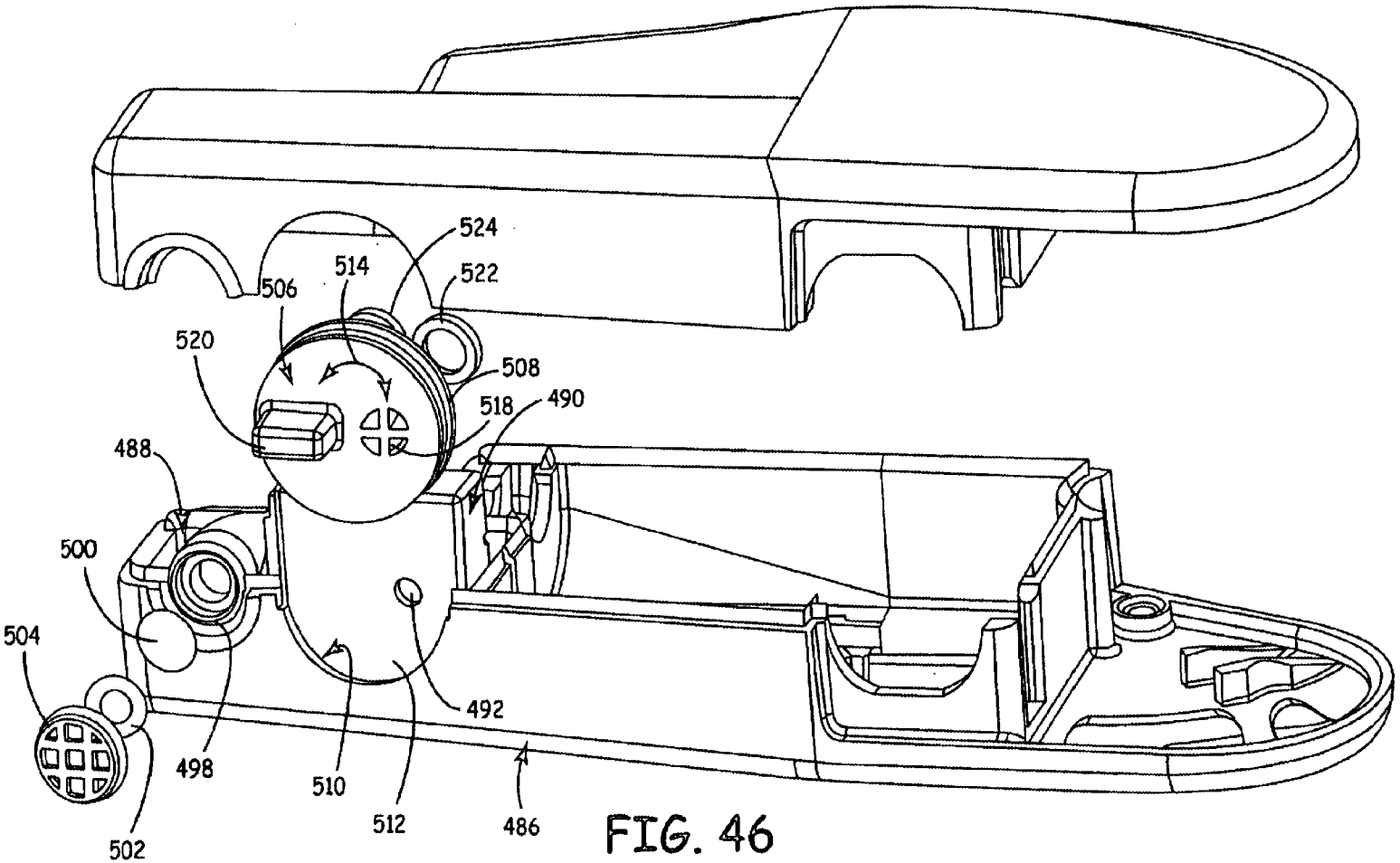
FIG. 46 is an exploded perspective view of the seventh alternative embodiment of the present invention.
Figure 47:
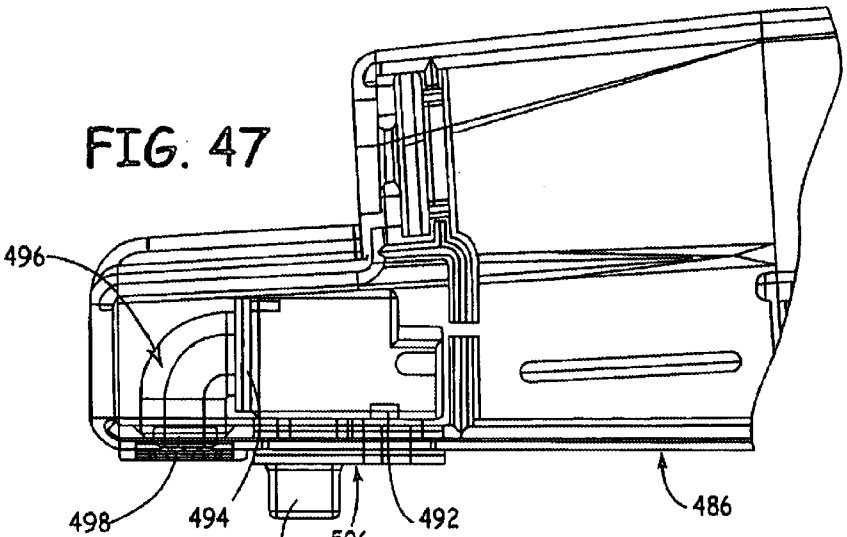
FIG. 47 is a partial top view of a housing half of the seventh alternative embodiment of the present invention.
Figure 48:
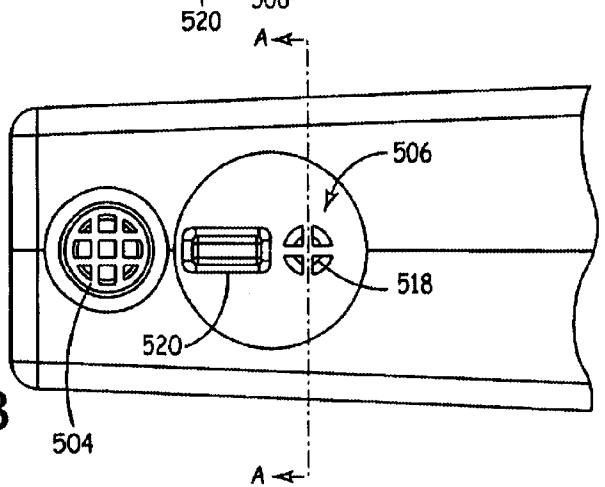
FIG. 48 is a partial side view of the seventh alternative embodiment of the present invention.
Figure 49:
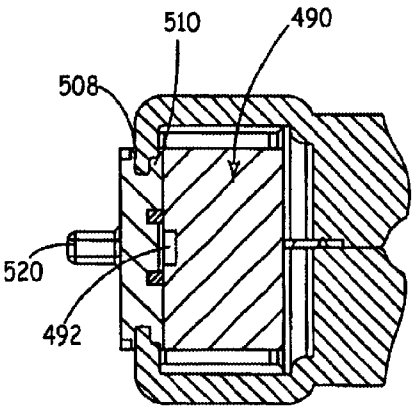
FIG. 49 is a sectional view of the seventh alternative embodiment of the present invention as viewed along the section line A—A of FIG. 48.

FIGS. 45 through 49 illustrate an alternate behind-the-ear housing and microphone construction generally indicated at 480. The embodiment 480 also includes first and second housing halves 482 and 484, respectively, joined together to form a unitary housing indicated at 486. Referring to FIG. 46, a directional microphone 490 is positioned in a compartment 488 within the housing 486. The directional microphone 490 is the same as the directional microphone described with respect to FIGS. 40 through 44. The directional microphone 490 includes a first acoustic port 492 and a second acoustic port 494 as best illustrated in FIG. 47. The second acoustic port 494 is acoustically connected to the exterior of the housing 486 through an acoustic passage 496 that is acoustically connected to an opening 498 in the housing 486, as best illustrated in FIGS. 46 and 47. A damper screen 500, O-ring 502 and wind screen 504 complete the acoustic construction at the outer surface of the housing 486. Alternatively, acoustic dampers can be mounted inside the microphone which is true for all of the designs described herein.

The switching mechanism 506 is cylindrical in configuration and includes an outer track 508 on its perimeter that engages an inwardly facing track 510 that defines an opening 512 of the housing 486 and within which the switching mechanism 506 is positioned. The switching mechanism 506 is rotatable in the general direction of arrows 514 as best illustrated in FIG. 46.

The switching mechanism 506 includes an acoustic opening 518 that is positionable over the acoustic port 492 of the microphone 490. When the acoustic opening 518 is positioned over the acoustic port 492, the switching mechanism 506 is in a first position and the microphone 490 is in a directional mode since sound waves reach both acoustic ports 492 and 494.

To place the microphone construction in an omni-directional mode, the switching element 514 is rotated to a second position wherein an acoustic blocking element (not shown) is positioned over the acoustic port 492 thereby preventing sound waves from reaching the microphone 490 through the port 492. A tab member 520 is used to turn or rotate the switching mechanism 514 between the first position and the second position. O-rings 522 and 524 are used to provide acoustic seals about the acoustic opening 518 and to the acoustic blocking element (not shown), respectively.

Figure 50:
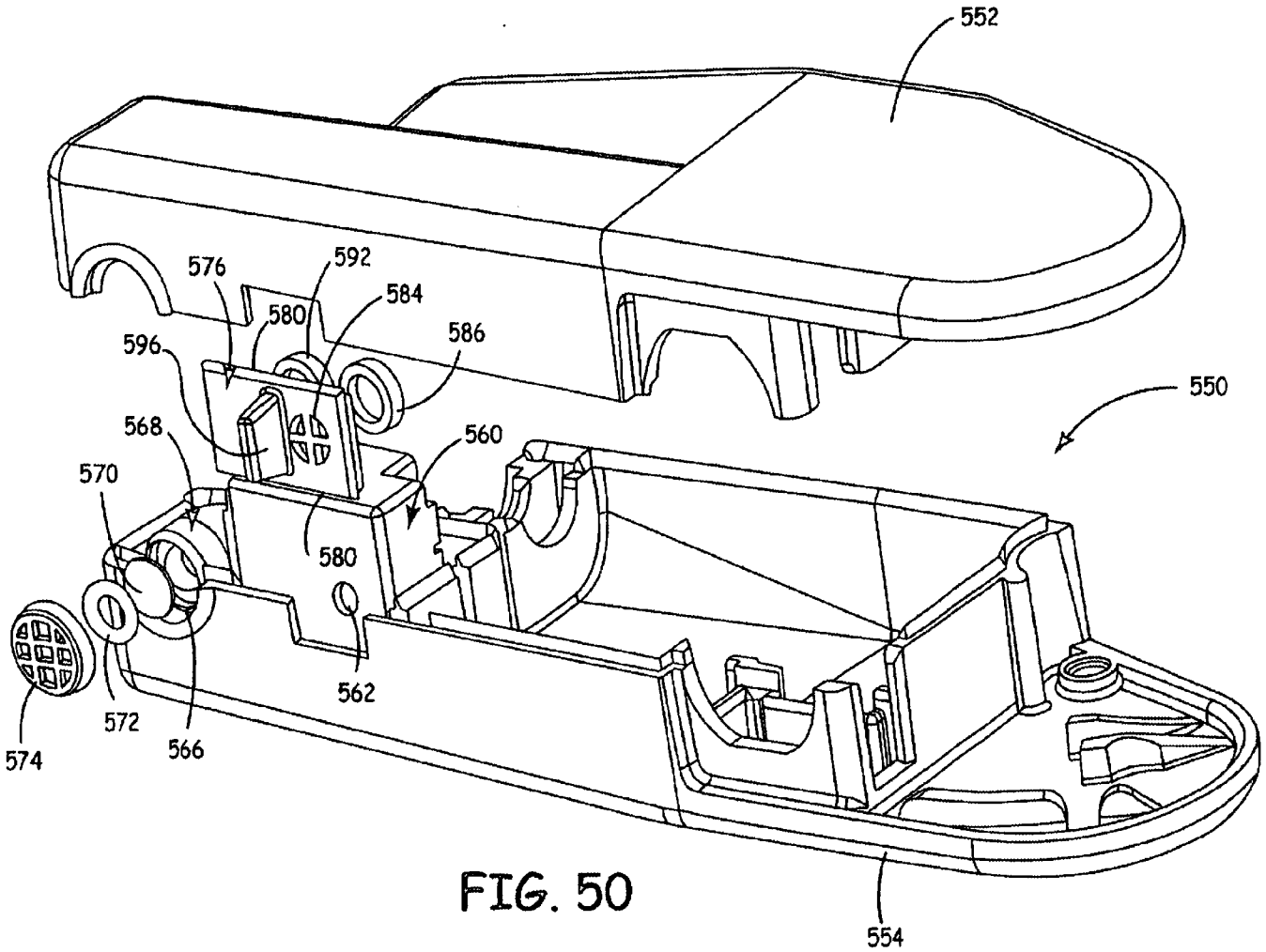
FIG. 50 is an exploded perspective view of an eighth alternative embodiment of the present invention where the embodiment is a behind the ear hearing aid.
Figure 51:
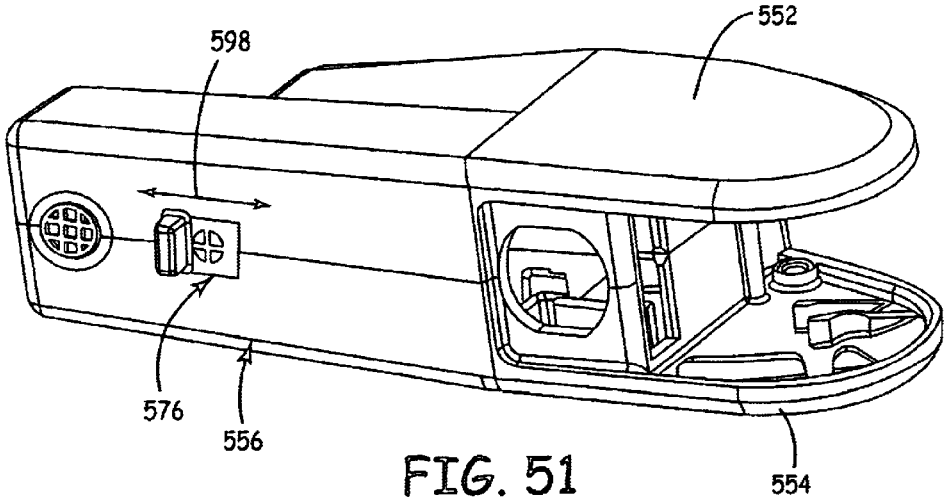
FIG. 51 is a perspective view of the eighth alternative embodiment of the present invention.
Figure 52:
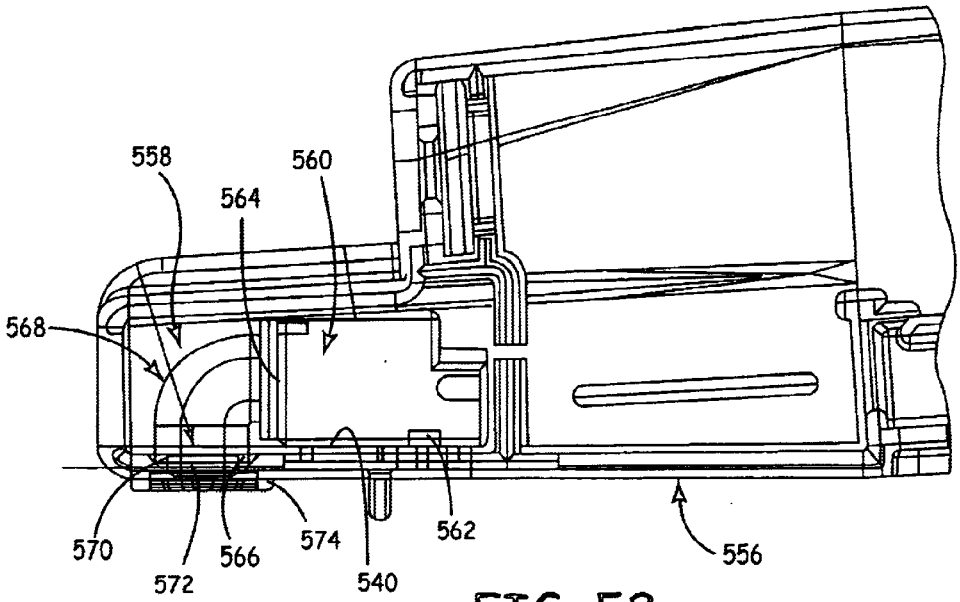
FIG. 52 is a partial top view of a housing half of the eighth alternative embodiment of the present invention.
Figure 53:
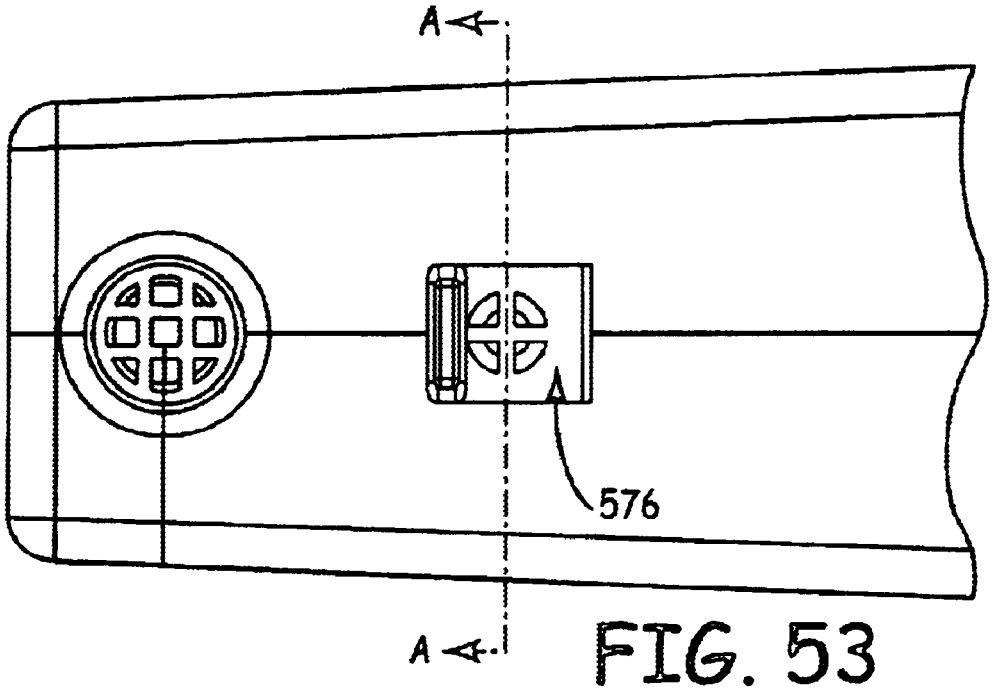
FIG. 53 is a partial side view of the eighth alternative embodiment of the present invention.

Another alternate embodiment 550 is illustrated in FIGS. 50 through 54. Again, the embodiment 550 is a behind-the-ear housing and microphone construction that includes a first housing half 552 and a second housing half 554 united together to form a unitary housing 556. As best illustrated in FIG. 52, the microphone construction including a directional microphone 560 having a first acoustical port 562 and a second acoustical port 564 is disposed within a compartment 558.

The acoustical port 564 is acoustically connected to an opening 566 of the housing 556 through an acoustical passage 568. A combination of an acoustic damper screen 570, an O-ring 572 and a wind screen 574 complete the construction of opening 566 as best illustrated in FIGS. 50 and 52. Alternatively, the damper may be mounted inside the microphone 560.

Figure 54:
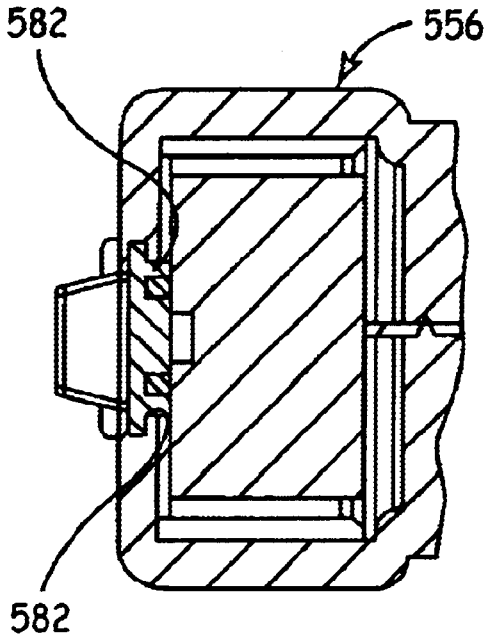
FIG. 54 is a sectional view of the eighth alternative embodiment of the present invention as viewed along the section line A—A of FIG. 53.

The switching mechanism 576 is much like the switching mechanism 444 of FIGS. 40 through 44 except that the switching mechanism 576 is slidable in a direction which is referred to as horizontal (primarily due to the illustration in the drawings and not to any use), and is 90 degrees from the movement of the switching mechanism 444 illustrated in FIGS. 40 through 44. The switching mechanism 576 includes tracks 580 disposed along opposing edges which engage tracks 582 in the housing 556, as best illustrated in FIG. 54.

The switching mechanism 576 includes an acoustic opening 584 that is positionable over acoustic port 562 of the microphone 560 when the switching mechanism 576 is in a first position. An O-ring 586 creates an acoustic seal between the microphone 560 and the acoustic opening 584 when the acoustic opening 584 is aligned with acoustic port 562. With the acoustic opening 584 aligned with the acoustic port 562, the switching mechanism 576 is in the first position and the microphone construction is in a directional mode since sound waves are carried to both ports of the directional microphone 560.

The switching mechanism 576 also includes an acoustical blocking element 590, as best illustrated in FIG. 52, and when in combination with O-ring 592 is position over acoustic port 562, the microphone construction is then in an omni-directional mode since sound waves are blocked from the acoustic port 562 of the microphone 560. When the blocking element 590 is positioned over the acoustic port 562, the switching mechanism 576 is in a second position and the microphone 560 is in the omni-directional mode. Additionally, the switching mechanism 576 includes a finger tab 596 to aid in pushing the sliding mechanism 576 back and forth in the general direction of arrows 598, as best illustrated in FIGS. 50 and 51.

Although the present invention has been described with reference to preferred embodiments, workers skilled in the art will recognize that changes may be made in form and detail without departing from the spirit and scope of the invention.

What is claimed is:

1. A microphone construction for use in a hearing aid, the construction comprising:

a faceplate having a first acoustic opening and a second acoustic opening;

a microphone wherein the microphone includes a first acoustic port in acoustic communication with the first acoustic opening in the faceplate and a second acoustic port in acoustic communication with the second acoustic opening in the faceplate; and a switching mechanism rotatably secured to a first surface of the faceplate, wherein the switching mechanism is disposed over the first acoustic opening and the second acoustic opening and movable between a first position wherein both the first acoustic port and the second acoustic port are in an acoustically receptive state and a second position wherein either the first acoustic port or the second acoustic port is in an acoustic non-receptive state.

2. The construction of claim 1 and further comprising a first acoustic passage acoustically connecting the first acoustic opening in the faceplate proximate a second surface to the first acoustic port of the microphone and a second acoustic passage acoustically connecting the second acoustic opening in the faceplate proximate the second surface to the second acoustic port in the microphone.

3. The construction of claim 2 wherein the first acoustic passage and the second acoustic passage are fixedly attached to the microphone.

4. The construction of claim 2 wherein the first acoustic passage and the second acoustic passage are retained to the microphone by a retaining clip.

5. The construction of claim 2 wherein the first and second acoustic passages frictionally engage the first and second acoustic openings in the faceplate.

6. The construction of claim 1 wherein a pin disposed through a surface defining an aperture within the switching mechanism engages a surface defining an aperture within the faceplate to rotatably secure the switching mechanism to the first surface of the faceplate.

7. The construction of claim 1 wherein the switching mechanism comprises first and second acoustic ports being in acoustic relationship with the first and second acoustic openings in the faceplate when the switching mechanism is positioned into the first position and a third acoustic port for being in an acoustic relationship with either the first acoustic opening or second acoustic opening in the faceplate and the other acoustic opening being in an acoustically unreceptive state when the switching mechanism is in the second position.

8. The construction of claim 7 wherein O-rings are disposed about the first, second and third acoustic ports to provide an acoustic seal between the first surface of the faceplate and the switching mechanism.

9. The construction of claim 7 wherein a stopping member extending from the faceplate cooperates with a cavity in the switching mechanism, the stopping member limiting the rotation of the switching mechanism between the first and second positions.

10. A microphone construction for use in a hearing aid, the construction comprising:

a faceplate having a first acoustic opening and a second acoustic opening;

a microphone wherein the microphone includes a first acoustic port in acoustic communication with the first acoustic opening in the faceplate and a second acoustic port in acoustic communication with the second acoustic opening in the faceplate; and a switching mechanism rotatably secured to a first surface of the faceplate and disposed over only either the first or second acoustic opening and positionable between a first position wherein the acoustic opening disposed beneath the switching mechanism is in an acoustically receptive state and a second position wherein the acoustic opening disposed beneath the switching mechanism is in an acoustically unreceptive state, the switching mechanism being rotatable secured to eh faceplate by a pin disposed through a surface defining an aperture within the switching mechanism wherein the pin engages a surface defining a through bore in the faceplate.

11. The construction of claim 10 and further comprising a first acoustic passage acoustically connecting the first acoustic opening to a second surface of the faceplate to the first acoustic port of the microphone and a second acoustic passage acoustically connecting the second acoustic opening to the second surface of the faceplate to the second acoustic port in the microphone.

12. The construction of claim 11 wherein the first acoustic passage and the second acoustic passage are fixedly attached to the microphone.

13. The construction of claim 11 wherein the first acoustic passage and the second acoustic passage are retained on the microphone by a retaining clip.

14. The construction of claim 11 wherein a housing having internal first and second acoustic passages is positioned proximate the second surface of the faceplate and having a chamber for retaining the microphone such that the first and second acoustic parts are in acoustic communication with the first and second acoustic passages, respectively.

15. The construction of claim 10 wherein the switching mechanism further comprises a first acoustic port wherein the first acoustic port of the switching mechanism is in acoustic relationship with either the first or second acoustic opening in the faceplate when the switching mechanism is positioned into the first position and wherein when the switching mechanism is positioned into the second position, the acoustic port is positioned away from the acoustic opening thereby causing the acoustic opening to be in an acoustically unreceptive state.

16. The construction of claim 15 wherein an O-ring is disposed about the acoustic port to provide an acoustic seal between the switching mechanism and the first surface of the faceplate.

17. The construction of claim 15 wherein a stopping member extending from the faceplate cooperates with a cavity in the switching mechanism thereby limiting the rotation of the switching mechanism to be between the first and second positions.

18. A microphone construction for use in a hearing aid, the construction comprising:

a faceplate comprising a first acoustic opening, a second acoustic opening and a surface defining an aperture;

a microphone including a first acoustic port and a second acoustic port wherein the first acoustic port disposes within the first acoustic opening proximate a first surface of the faceplate;

a housing having an acoustic passage which acoustically connects the second acoustic opening in the faceplate proximate a first surface of the faceplate to the second acoustic port in the microphone when the microphone is disposed within a microphone retaining chamber within the housing and wherein the housing includes a post disposed through the surface defining the aperture in the faceplate; and a switching mechanism operably secured to the post and positioned proximate a second surface of the faceplate, the switching mechanism movable between a first position wherein both the first acoustic port and the second acoustic port are in an acoustically receptive state and a second position wherein either the first acoustic port or the second acoustic port is in an acoustic non-receptive state.

19. The construction of claim 18 wherein the post includes a pair of grooves which engage channels within the switching mechanism to provide a slidable engagement of the post to the switching mechanism.

20. The construction of claim 19 wherein the switching mechanism further comprises an arcuate recess proximate a first end such that when the switching mechanism is positioned into the first position the recess disposes about the first acoustic opening and the second acoustic opening is uncovered by the switching mechanism such that the first and second acoustic openings are in an acoustic receptive state and wherein the switching mechanism includes an acoustic blocking element which covers the second acoustic opening and is displaced from the first acoustic opening when the switching mechanism is positioned into the second position such that the first acoustic opening is in an acoustic receptive state and the second acoustic opening is in an acoustic non-receptive state.

21. The construction of claim 19 wherein a gripping member is positioned on a first surface of the switching member for positioning the switching mechanism between the first and second positions.

22. The construction of claim 18 and further comprising:

a second surface defining a second aperture within the faceplate;

a second post extending from the housing and disposed through the second surface defining the aperture in the faceplate; and the switching mechanism operably secured to the second post.

23. The construction of claim 22 wherein the second post includes grooves similar to the grooves within the first post and wherein the switching mechanism includes first and second slots proximate first and second ends of the switching mechanism wherein the first and second slots include channels which slidably engage the grooves of the first and second posts.

24. The construction of claim 23 wherein a length of the first and second slots limits a travel of the switching mechanism thereby preventing the switching mechanism from engaging the first acoustic opening.

25. The construction of claim 22 wherein the switching mechanism includes an acoustic port and an acoustic blocking element wherein when the switching mechanism is positioned into the first position the acoustic port disposes over the second acoustic opening placing the second acoustic port of the microphone in an acoustic receptive state and wherein the switching mechanism when positioned into the second position disposes the acoustic blocking element over the second acoustic opening thereby acoustically blocking the second acoustic opening and placing the second acoustic port of the microphone in an acoustic unreceptive state.

26. A microphone construction for use in a hearing aid, the construction comprising:

a housing formed from first and second matching housing halves joined together, the first housing half having a first acoustic passage and the second housing half having a second acoustic passage, the housing halves having a microphone retaining chamber;

a microphone disposed in the microphone retaining chamber and having first and second acoustic ports positioned to be in an acoustic relationship with the first and second acoustic passages; and a switching mechanism slidably secured to the housing and movable between a first position wherein the first and second acoustic passages are in an acoustic receptive state and a second position when either the first or second passage is blocked by the switching mechanism and the other passage is in an acoustic receptive state.

27. The construction of claim 26 and further including first and second acoustic ports within the switching mechanism being in an acoustic relationship with the acoustic passages of the first and second housing halves when the switching mechanism is in the first position, and a third acoustic port being in an acoustic relationship with either the first or second acoustic passage when the switching mechanism is in the second position.

28. The construction of claim 27 wherein O-rings are secured to the first, second and third acoustic ports such that the acoustic ports are in a sealing relationship with a surface of the housing providing an acoustic seal with the first and second acoustic passages when in the first position and an acoustic seal when in the second position between the third acoustic port and the second acoustic passage.

29. The construction of claim 26 wherein the switching mechanism includes an outwardly projecting tab for engagement to slide the switching mechanism between the first and second positions.

30. The construction of claim 26 and further including a stop member projecting outwardly from the housing and a slot within the switching mechanism, a first end of the slot engages the stop member thereby positioning the switching mechanism in the first position and the switching mechanism slides into the second position when a second end of the slot engages the stop member.

31. A construction for a behind the ear hearing aid comprising:

first and second housing halves cooperating to form a housing wherein the housing includes a chamber for retaining a microphone, a wall of the chamber having a first acoustic opening and a second acoustic opening;

a microphone disposed within the chamber having a first acoustic port and a second acoustic port wherein the first acoustic port is in an acoustic relationship with the first acoustic opening and the second acoustic port is in an acoustic relationship with the second acoustic opening; and a switching mechanism operably secured within the second acoustic opening of the housing and movable between a first position wherein both the first acoustic port and the second acoustic port of the microphone are in an acoustically receptive state and a second position wherein the first acoustic port is in an acoustic receptive state and the second acoustic port is in an acoustic non-receptive state, and wherein the switching mechanism is rotatable secured between the housing halves and positionable between the first and second positions.

32. The construction of claim 31 wherein the switching mechanism being operably attached to the housing includes an acoustic port and a blocking port wherein the switching mechanism when positioned into the first position aligns that the acoustic port with the second acoustic opening within the housing thereby placing the second acoustic port of the microphone in an acoustic receptive state and the microphone in the directional mode and the switching mechanism when positioned into the second position disposes the blocking port over the second acoustic opening in the housing thereby placing the second acoustic port of the microphone in an acoustic non-receptive state and the microphone in the omni-directional mode.

33. The construction of claim 32 wherein the switching mechanism is slidable along the seam of the first and second housing halves and positionable between the first and second positions.

34. The construction of claim 32 wherein the switching mechanism is slidable perpendicular to the seam of the first and second housing halves and positionable between the first and second positions.

35. The construction of claim 31 and further comprising an acoustic passage acoustically connecting the first acoustic port to the first acoustic opening.

36. The construction of claim 31 wherein the second acoustic port disposes within the second acoustic opening.

* * * * *